US009454099B2

(12) United States Patent
Yamabe et al.

(10) Patent No.: US 9,454,099 B2
(45) Date of Patent: Sep. 27, 2016

(54) TONER CONTAINER INCLUDING A LID MEMBER PULLED OUT IN AN INCLINED DIRECTION

(71) Applicants: Junji Yamabe, Shizuoka (JP); Seiji Terazawa, Shizuoka (JP); Masashi Hasegawa, Shizuoka (JP)

(72) Inventors: Junji Yamabe, Shizuoka (JP); Seiji Terazawa, Shizuoka (JP); Masashi Hasegawa, Shizuoka (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/776,407

(22) PCT Filed: Mar. 13, 2014

(86) PCT No.: PCT/JP2014/057643
§ 371 (c)(1),
(2) Date: Sep. 14, 2015

(87) PCT Pub. No.: WO2014/142353
PCT Pub. Date: Sep. 18, 2014

(65) Prior Publication Data

US 2016/0033898 A1 Feb. 4, 2016

(30) Foreign Application Priority Data

Mar. 14, 2013 (JP) ..... 2013-051185
Mar. 14, 2013 (JP) ..... 2013-052306

(51) Int. Cl.
*G03G 15/00* (2006.01)
*G03G 15/08* (2006.01)

(52) U.S. Cl.
CPC ..... *G03G 15/0877* (2013.01); *G03G 15/0872* (2013.01); *G03G 15/0886* (2013.01); *G03G 15/0889* (2013.01)

(58) Field of Classification Search
CPC ..... G03G 15/0877; G03G 15/0886; G03G 15/0872; G03G 15/0868; G03G 2215/0668; G03G 2215/0678; G03G 2215/0692; G03G 2215/067; G03G 2221/1657
See application file for complete search history.

(56) References Cited

U.S. PATENT DOCUMENTS 5,765,079 A * 6/1998 Yoshiki ..... G03G 15/0868 222/167
5,828,935 A * 10/1998 Tatsumi ..... G03G 15/0855 399/258

(Continued)

FOREIGN PATENT DOCUMENTS

JP 07-168430 7/1995
JP 10-048935 2/1998

(Continued)

OTHER PUBLICATIONS

International Search Report issued on Jun. 24, 2014 in PCT/JP2014/057643 filed on Mar. 13, 2014.

*Primary Examiner* — Clayton E Laballe
*Assistant Examiner* — Trevor J Bervik
(74) *Attorney, Agent, or Firm* — Oblon, McClelland, Maier & Neustadt, L.L.P.

(57) ABSTRACT

An image forming apparatus includes a lid pulling mechanism that includes a hook to open a toner discharge opening by pulling, from the bottle head section, a lid member that is in contact with a bottle head section of a toner bottle to close the toner discharge opening, and the lid pulling mechanism pulls the lid member in a direction inclined upward with respect to a virtual line that extends in a horizontal direction. Therefore, the distance is decreased between the lid member and the bottle head section and above the toner discharge opening through which air easily passes; thus, intake of air from the outside to the inside of the bottle head section is prevented. Furthermore, it is possible to prevent the occurrence of spread of toner from the inside of the bottle head section to the outside of the container.

36 Claims, 24 Drawing Sheets

(56) References Cited

U.S. PATENT DOCUMENTS

| | | | | |
|---|---|---|---|---|
| 5,907,756 | A | 5/1999 | Shirota et al. | |
| 5,970,290 | A * | 10/1999 | Yoshiki | G03G 15/0868 399/261 |
| 5,983,059 | A | 11/1999 | Oka et al. | |
| 6,678,492 | B1 | 1/2004 | Terazawa et al. | |
| 6,701,112 | B2 | 3/2004 | Kusano et al. | |
| 7,127,193 | B2 * | 10/2006 | Yamada | G03G 15/0881 399/106 |
| 8,099,028 | B2 * | 1/2012 | Yamada | G03G 15/0886 399/262 |
| 8,306,451 | B2 * | 11/2012 | Yomoda | G03G 15/0886 399/106 |
| 2001/0017998 | A1 | 8/2001 | Terazawa et al. | |
| 2002/0122676 | A1 | 9/2002 | Yamada et al. | |
| 2005/0196198 | A1 * | 9/2005 | Kawamura | G03G 15/0872 399/262 |
| 2010/0119264 | A1 | 5/2010 | Yamaguchi et al. | |
| 2010/0209141 | A1 | 8/2010 | Ikado | |
| 2010/0284710 | A1 | 11/2010 | Sasaki et al. | |
| 2011/0020039 | A1 | 1/2011 | Mitsuishi et al. | |
| 2012/0301188 | A1 | 11/2012 | Yamabe et al. | |
| 2013/0011166 | A1 | 1/2013 | Yamaguchi et al. | |

FOREIGN PATENT DOCUMENTS

| | | |
|---|---|---|
| JP | 10-083113 | 3/1998 |
| JP | 2001-066869 | 3/2001 |
| JP | 2002-318490 | 10/2002 |
| JP | 2005-178810 | 7/2005 |
| JP | 4011831 | 9/2007 |
| JP | 2010-134408 | 6/2010 |
| JP | 2010-191016 | 9/2010 |

* cited by examiner

TONER CONTAINER INCLUDING A LID MEMBER PULLED OUT IN AN INCLINED DIRECTION

TECHNICAL FIELD

The present invention relates to an image forming apparatus that includes a toner-image forming unit that forms a toner image by using toner and includes a toner supply unit that supplies, to the toner-image forming unit, toner that is discharged from a toner container. Furthermore, it relates to a toner container that contains toner that is supplied to the toner-image forming unit of the image forming apparatus.

BACKGROUND ART

Conventionally, a toner supply unit that is described in Patent Literature 1 (Japanese Patent Application Laid-open No. 2005-178810) is known as a toner supply unit that is used in this type of image forming apparatus. FIG. 54 is a cross-sectional view that illustrates a head section of a toner container that is attached to the toner supply unit described in Patent Literature 1. Although a toner container 900 is formed into a cylindrical shape, this figure illustrates only the container head section that is the end section of the cylindrical toner container 900 in the direction of a cylinder axis line. The container head section of the toner container 900 is connected to a lid member 901 that closes a toner discharge opening that is provided on the container head section. An undepicted toner supply unit holds the cylindrical toner container 900 in a position such that the direction of the cylinder axis line of the toner container 900 extends in a horizontal direction. As illustrated in FIG. 55, the toner supply unit, which holds the toner container 900, holds a handle section 901*a* by using a lid pulling mechanism 950, the handle section 901*a* protruding from the front surface of the lid member 901 of the toner container 900. Then, the lid pulling mechanism 950 moves in a direction away from the toner container 900 along the direction of the cylinder axis line of the toner container 900 so that the lid member 901 is pulled out of the container head section of the toner container 900 as illustrated in the drawing, whereby the toner discharge opening is opened. Thus, a gap is formed between the toner discharge opening and the lid member 901 that is pulled out of the container head section. In this state, the toner container 900 is rotated about the cylinder axis line of the toner container 900. In accordance with the rotation, toner in the container is moved from the container rear end section side toward the container head section due to an effect of a helical protrusion that is provided on the inner peripheral surface of the toner container 900, whereby the discharge of toner through the toner discharge opening is facilitated. The toner discharged through the toner discharge opening is conveyed by an undepicted conveying unit and is supplied to a developing apparatus.

With the toner supply unit that have the above configuration, as illustrated in FIG. 55, after toner is discharged through the toner discharge opening, the discharged toner passes through, out of the entire area of the gap formed between the toner discharge opening and the lid member 901, an area of the lower end section in a vertical direction. Contrary to this, no toner passes through an area of the upper end section of the gap in a vertical direction; therefore, a space is formed therein. While the toner container 900 is driven to rotate, air passes through the space as indicated by the arrow in the drawing, and the air outside the container is easily taken in through the toner discharge opening. Thus, there is a possibility that the taken air blows the toner in the container and the spread of toner from the inside of the container to the outside thereof is facilitated.

Even if the toner container 900 is not configured to be driven to rotate, there is a possibility that toner is spread in the similar manner if a configuration is such that the toner discharge opening faces lateral to the container as illustrated in the drawing. For example, if the image forming apparatus has a configuration for driving and rotating a conveying member that conveys toner, although the toner container 900 is not driven to rotate, there is a possibility that air is taken in the container through the above-described space due to the driving and rotating of the conveying member and the toner is spread around. Furthermore, for example, if a moderate air current is generated from above toward below the apparatus due to driving of an exhaust air fan, or the like, there is a possibility that the air current enters the container through the toner discharge opening that faces lateral to the container, as indicated by the arrow in FIG. 55, and toner is spread around. If a configuration is such that the toner container is set in the toner supply unit in a position such that the toner discharge opening faces lateral to the container, there is a possibility that toner is spread around in a similar manner.

The present invention is made in consideration of the above problem and has an object to provide the following image forming apparatus and toner container. Specifically, it is an image forming apparatus, or the like, that can prevent the occurrence of spread of toner from the inside of the toner container to the outside thereof, the toner container being held by a toner supply unit in a position such that a toner discharge opening faces lateral to the container.

DISCLOSURE OF INVENTION

In order to solve the above-described problem, the present invention is characterized in that an image forming apparatus includes a toner-image forming unit that forms a toner image by using toner; a toner supply unit that holds the toner container in a position such that a toner discharge opening of the toner container faces lateral to the container while it supplies, to the toner-image forming unit, toner that is discharged through the toner discharge opening; and a lid pulling unit that pulls out, from a main body of the toner container, a lid member that abuts the main body to close the toner discharge opening, thereby opening the toner discharge opening, wherein the lid pulling unit pulls out the lid member in a direction inclined upward with respect to a virtual line that extends in a horizontal direction.

The present invention is different from the configuration illustrated in FIG. 55 and, for the reason described below, it is possible to prevent the occurrence of spread of toner from the container head section of the toner container to the outside of the container. Specifically, in FIG. 55, out of the entire area of the gap formed between the toner discharge opening of the container head section and the lid member 901 that is pulled out of the container head section, the discharged toner passes through an area of the lower end section in a vertical direction. Therefore, in order to prevent accumulation of toner at the area, it is necessary to obtain a large distance between the toner discharge opening and the lid member 901 to some extent. According to the present invention, in order to obtain it, the lid member is pulled out in a direction inclined upward with respect to a virtual line so that the lid member is in an obliquely upward position. Thus, the size of the gap formed between the toner discharge opening of the container head section and the lid member that is pulled out of the container head section is obtained as described below. That is, out of the entire area of the gap in a vertical direction, the area of the lower end section through which toner passes is larger than the area of the upper end section through which air passes. Thus, an adequate distance is obtained between the toner discharge opening and the lid member in the area of the lower end section through which toner passes, and toner is discharged in a desired manner. Furthermore, the distance between the toner discharge opening and the lid member is decreased in the area of the upper end section through which toner does not pass, and intake of air is prevented. Thus, intake of air is prevented in the area of the upper end section through which air easily passes, and it is possible to produce an advantage of preventing the occurrence of spread of toner from the inside of the container head section to the outside of the container.

DESCRIPTION OF EMBODIMENTS

An explanation is given below of an embodiment of the present invention that is applied to an electrophotographic printer (hereafter, simply referred to as a "printer") that is an image forming apparatus.

Figure 1:
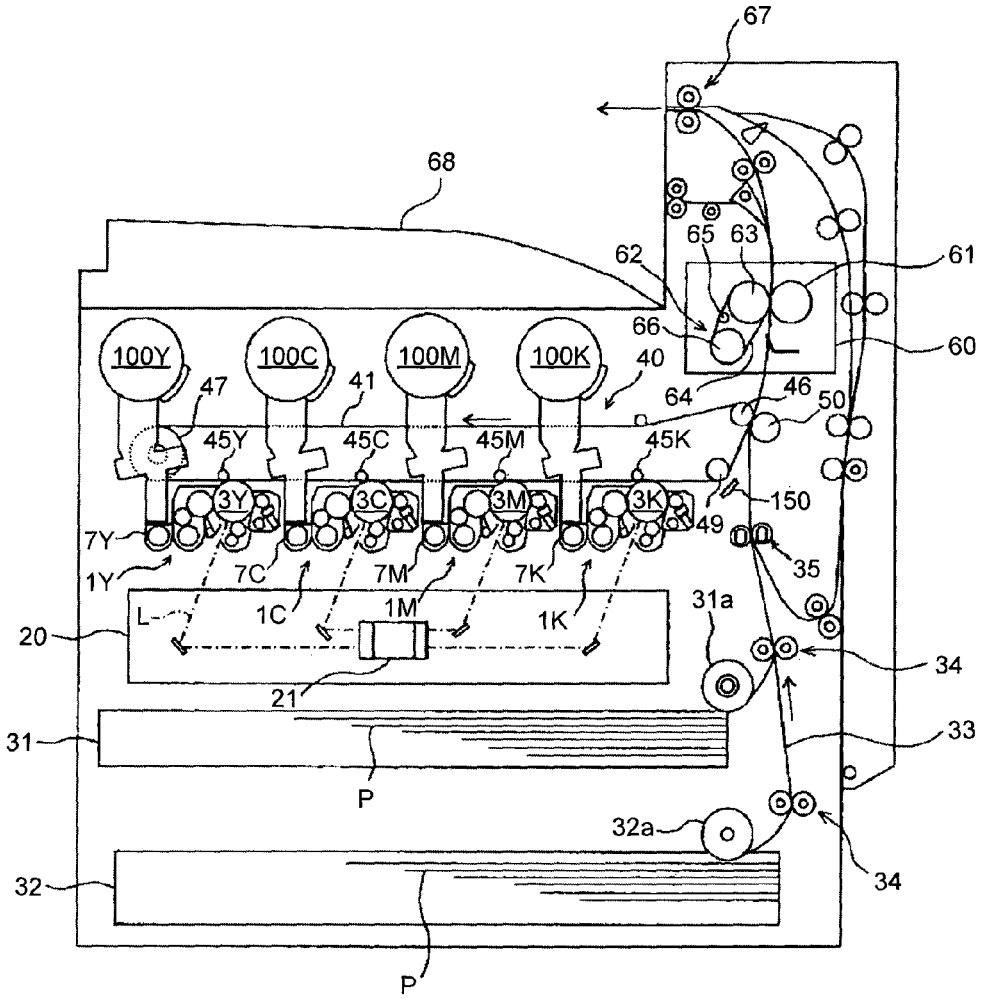
FIG. 1 is a schematic configuration diagram that illustrates a printer according to an embodiment.

First, an explanation is given of a basic configuration of the printer according to the embodiment. FIG. 1 is a schematic configuration diagram that illustrates the printer according to the embodiment. The printer includes four image forming units 1Y, 10, 1M, and 1K for yellow, cyan, magenta, and black (hereafter, referred to as Y, C, M, and K). They use toner of different colors, i.e., Y, C, M, and K, as image forming materials to form images; otherwise, they have the same configurations.

Figure 2:
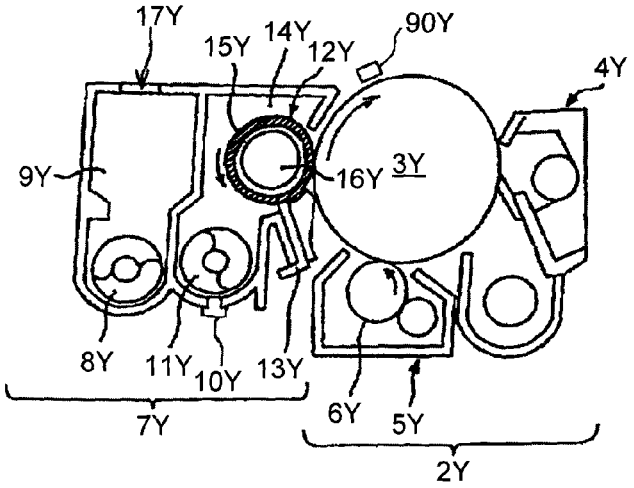
FIG. 2 is a schematic view that illustrates a configuration of an image forming unit for forming a Y toner image in the printer.
Figure 3:
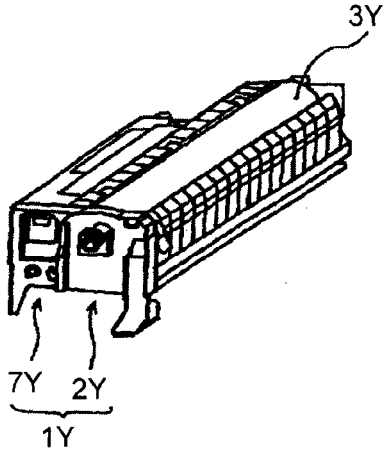
FIG. 3 is a perspective view that illustrates the external of the image forming unit.

FIG. 2 is a schematic view that illustrates a configuration of the image forming unit 1Y for forming a Y toner image. Furthermore, FIG. 3 is a perspective view that illustrates the external of the image forming unit 1Y that is a toner-image forming unit. In these figures, the image forming unit 1Y includes a photosensitive unit 2Y and a developing unit 7Y. As illustrated in FIG. 3, the photosensitive unit 2Y and the developing unit 7Y are configured to be integrally attached to or removed from the printer main body as the image forming unit 1Y. Furthermore, while they are removed from the printer main body, the developing unit 7Y can be attached to or removed from the photosensitive unit.

The photosensitive unit 2Y includes a photosensitive element 3Y that is a drum-like latent-image carrier, a drum cleaning device 4Y, a neutralization device, a charge device 5Y, or the like. By using a charge roller 6Y, the charge device 5Y that is a charge unit uniformly charges the surface of the photosensitive element 3Y that is driven to rotate in a clockwise direction in FIG. 2 by a drive unit. Specifically, in FIG. 2, a power source applies a charge bias to the charge roller 6Y that is driven to rotate in a counterclockwise direction, and the charge roller 6Y is moved close to or is brought into contact with the photosensitive element 3Y, whereby the photosensitive element 3Y is uniformly charged.

Furthermore, instead of the charge roller 6Y, a different charge member, such as a charge brush, may be used to be moved close to or be brought into contact with it. Moreover, the photosensitive element 3Y may be uniformly charged by using a charge method, such as a scorotron charger. The surface of the photosensitive element 3Y that is uniformly charged by the charge device 5Y is exposed to laser light that is emitted by an optical writing unit 20 that is a latent-image forming unit, which will be explained later, for scanning, and a Y electrostatic latent image is carried thereon.

Figure 4:
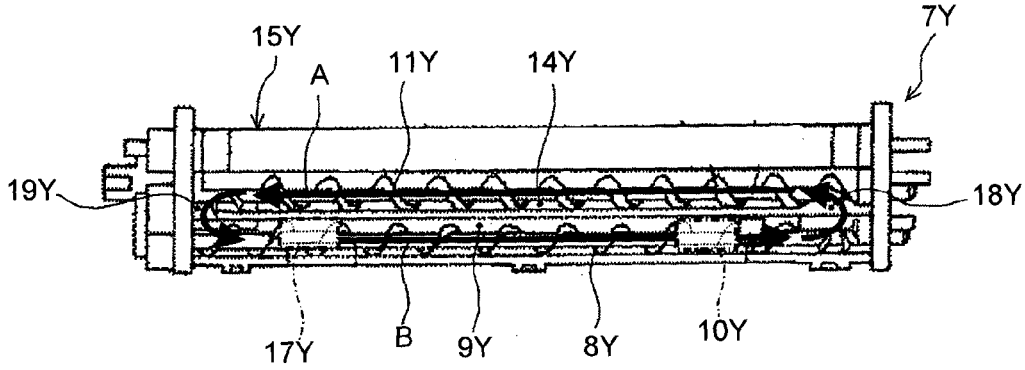
FIG. 4 is an exploded configuration diagram that illustrates the inside of a developing unit of the image forming unit.

FIG. 4 is an exploded configuration diagram that illustrates the inside of the developing unit 7Y. As illustrated in FIGS. 2 and 4, the developing unit 7Y, which is a developing unit, includes a first agent container 9Y that accommodates a first conveyor screw 8Y that is a developer conveying unit. It further includes a second agent container 14Y that accommodates a toner concentration sensor 10Y that is a toner-concentration detection unit that includes a magnetic permeability sensor, a second conveyor screw 11Y that is a developer conveying unit, a developing roll 12Y that is a developer carrier, a doctor blade 13Y that is a developer adjustment member, or the like.

The two agent containers have a circulation pathway formed therein and contain a Y developer that is a two component developer including a magnetic carrier and a negatively charged Y toner. The first conveyor screw 8Y is driven to rotate by a drive unit so that the Y developer in the first agent container 9Y is conveyed to the front side in FIG. 2 (in the direction of the arrow B in FIG. 4). While the Y developer is conveyed, the toner concentration sensor 10Y, which is fixed above the first conveyor screw 8Y, detects the toner concentration of the Y developer that passes through a predetermined detection area that is located downstream of the area opposed to a toner supply opening 17Y in the first agent container 9Y in a developer circulation direction. After the Y developer is conveyed to the end section of the first agent container 9Y by the first conveyor screw 8Y, the Y developer enters the second agent container 14Y through a communication opening 18Y.

The second conveyor screw 11Y in the second agent container 14Y is driven to rotate by a drive unit so that the Y developer is conveyed to the back side in FIG. 2 (in the direction of the arrow A in FIG. 4). Above the second conveyor screw 11Y that conveys the Y developer as described above, the developing roll 12Y is provided in a position parallel to the second conveyor screw 11Y. The developing roll 12Y is configured to include a magnet roller 16Y that is fixedly installed inside a developing sleeve 15Y that is a non-magnetic sleeve and that is driven to rotate in a counterclockwise direction in FIG. 2.

Part of the Y developer that is conveyed by the second conveyor screw 11Y is attracted to the surface of the developing sleeve 15Y due to the magnetic force generated by the magnet roller 16Y. Then, after the layer thickness thereof is adjusted by the doctor blade 13Y that is provided such that a predetermined gap is maintained with the surface of the developing sleeve 15Y, it is conveyed to a developing area that is opposed to the photosensitive element 3Y, whereby the Y toner is attached to the Y electrostatic latent image on the photosensitive element 3Y. Due to the attachment, a Y toner image is formed on the photosensitive element 3Y. After the Y toner is consumed during the development, the Y developer is returned to the second conveyor screw 11Y in accordance with the rotation of the developing sleeve 15Y. After the Y developer is conveyed to the end of the second agent container 14Y by the second conveyor screw 11Y, it is returned to the first agent container 9Y through a communication opening 19Y. Thus, the Y developer is circulated and conveyed within the developing unit.

A detection result obtained by the toner concentration sensor 10Y with regard to the toner concentration of the Y developer is sent, as an electric signal, to a control device. The control device converts an output voltage from the toner concentration sensor 10Y in a RAM into the toner concentration of the Y developer. Furthermore, it converts an output voltage from toner concentration sensors (10C, 10M, and 10K) that are provided in developing units (7C, 7M, and 7K) for C, M, and K into the toner concentrations of the developers (C, M, and K developers). Moreover, an output voltage from the toner concentration sensor that is a magnetic permeability sensor is correlated to the toner concentration. As the toner concentration of the developer is increased, the magnetic permeability of the developer is decreased and thus the output value from the toner concentration sensor becomes lower.

With regard to the developing unit 7Y for Y, the toner concentration detection result that is calculated on the basis of the output voltage from the toner concentration sensor 10Y is compared with a control target value of the Y toner concentration that is stored in a RAM. Then, in order to supply, through the toner supply opening 17Y, the amount of Y toner that corresponds to the comparison result, a Y supply motor of a toner supply device is driven for a period of time that corresponds to the amount. Therefore, in the first agent container 9Y, an appropriate amount of Y toner is supplied to the Y developer that has a lower Y toner concentration due to the consumption of the Y toner during development. Thus, the toner concentration of the Y developer in the second agent container 14Y is kept nearly at a target value of the toner concentration. The same holds for the developers in the developing units 7C, 7M, and 7K for the other colors.

In FIG. 1, the Y toner image formed on the photosensitive element 3Y is intermediately transferred onto an intermediate transfer belt 41 that is an intermediate transfer unit. The drum cleaning device 4Y in the photosensitive unit 2Y removes toner that remains on the surface of the photosensitive element 3Y after an intermediate transfer process is performed. The surface of the photosensitive element 3Y on which the cleaning operation is performed as above is neutralized by the neutralization device. Due to this neutralization, the surface of the photosensitive element 3Y is reset and stands by for the next image formation. In the same manner with respect to the image forming units 1C, 1M, and 1K for the other colors, a C toner image, M toner image, and K toner image are formed on photosensitive elements 3C, 3M, and 3K and are intermediately transferred onto the intermediate transfer belt 41.

The optical writing unit 20 is provided under the image forming units 1Y, 10, 1M, and, 1K. The optical writing unit 20 emits laser light L on the basis of image information, and the photosensitive elements 3Y, 3C, 3M, and 3K of the image forming units 1Y, 10, 1M, and 1K are irradiated with the laser light L. Thus, Y, C, M, and K electrostatic latent images are formed on the photosensitive elements 3Y, 3C, 3M, and 3K.

In the optical writing unit 20, while the laser light L emitted by a light source is deflected by a polygon mirror 21 that is driven to rotate by a motor, the photosensitive elements 3Y, 3C, 3M, and 3K are irradiated with the laser light L through multiple optical lenses and mirrors. Instead of the one that has the above configuration, the one that uses an LED array may be used.

A first sheet feeding cassette 31 and a second sheet feeding cassette 32 are provided under the optical writing unit 20 such that they overlap with each other in a vertical direction. Each of the sheet feeding cassettes contains multiple recording sheets P that are recording materials and are overlapped as a bundle of recording sheets, and the top recording sheets P are in contact with a first sheet feeding roller 31*a* and a second sheet feeding roller 32*a*. When the first sheet feeding roller 31*a* is driven to rotate in a counterclockwise direction in FIG. 1 by a drive unit, the top recording sheet P in the first sheet feeding cassette 31 is discharged into a sheet feeding path 33 that is provided such that it extends in a vertical direction on the right side of the cassette in FIG. 1. Furthermore, when the second sheet feeding roller 32*a* is driven to rotate in a counterclockwise direction in FIG. 1 by a drive unit, the top recording sheet P in the second sheet feeding cassette 32 is discharged into the sheet feeding path 33.

Multiple pairs of conveying rollers 34 are provided in the sheet feeding path 33, and the recording sheet P is delivered into the sheet feeding path 33, is sandwiched between the conveying rollers 34 of the pair, and is then conveyed through the sheet feeding path 33 upward in a vertical direction.

A pair of registration rollers 35 is provided on the end of the sheet feeding path 33. Immediately after the recording sheet P that is delivered from the pair of conveying rollers 34 is sandwiched between the registration rollers 35 of the pair, the rotation of the rollers is temporarily stopped. Then, the recording sheet P is delivered toward a secondary transfer nip, which will be explained later, at an appropriate timing.

Above the image forming units 1Y, 1C, 1M, and 1K is provided a transfer unit 40 that endlessly moves the intermediate transfer belt 41 in a counterclockwise direction, the intermediate transfer belt 41 being extended therein. The transfer unit 40 includes, in addition to the intermediate transfer belt 41, a belt cleaning unit 42, a first bracket 43, a second bracket 44, or the like. It further includes four primary transfer rollers 45Y, 45C, 45M, and 45K, a secondary transfer backup roller 46, a drive roller 47, an auxiliary roller 48, a nip entry roller 49, or the like. The intermediate transfer belt 41 is endlessly moved in a counterclockwise direction in FIG. 1 due to the rotational driving of the drive roller 47 while the intermediate transfer belt 41 is extended between the above rollers.

The endlessly moving intermediate transfer belt 41 is sandwiched between the four primary transfer rollers 45Y, 45C, 45M, and 45K and the photosensitive elements 3Y, 3C, 3M, and 3K, whereby primary transfer nips are formed therebetween. Then, a transfer bias that has a polarity opposite to that of toner (in the present embodiment, positive polarity) is applied to the inner peripheral surface of the intermediate transfer belt 41. While the intermediate transfer belt 41 sequentially passes through the Y, C, M, and K primary transfer nips in accordance with the endless movement, the toner images of the various colors on the photosensitive elements 3Y, 3C, 3M, and 3K are primarily transferred onto the outer peripheral surface of the intermediate transfer belt 41 in an overlapped manner. Thus, the overlapped toner images of the four colors (hereafter, referred to as the "four color toner images") are formed on the intermediate transfer belt 41.

The intermediate transfer belt 41 is sandwiched between the secondary transfer backup roller 46 and a secondary transfer roller 50 that is provided outside the loop of the intermediate transfer belt 41, whereby a secondary transfer nip is formed. The above-described pair of registration rollers 35 delivers the recording sheet P, which is sandwiched between the rollers, toward the secondary transfer nip at a timing that can be synchronized with the four color toner images on the intermediate transfer belt 41. The four color toner images on the intermediate transfer belt 41 are secondarily transferred onto the recording sheet P all together in the secondary transfer nip due to the secondary transfer electric field that is formed between the secondary transfer roller 50 to which a secondary transfer bias is applied and the secondary transfer backup roller 46 or due to the effect of the nip pressure. Then, a full-color toner image is formed together with the white color of the recording sheet P.

After the intermediate transfer belt 41 passes through the secondary transfer nip, transfer residual toner that has not been transferred onto the recording sheet P adheres to the intermediate transfer belt 41. The belt cleaning unit performs cleaning on it. The belt cleaning unit brings a cleaning blade in contact with the front surface of the intermediate transfer belt 41, thereby scraping and removing the transfer residual toner from the belt.

A fixing unit 60 that is a fixing unit is provided above the secondary transfer nip in the drawing. The fixing unit 60 includes a pressure heater roller 61 that includes a heat source, such as a halogen lamp, and a fixing belt unit 62. The fixing belt unit 62 includes a fixing belt 64, a heater roller 63 that includes a heat source, such as a halogen lamp, a tension roller 65, a drive roller 66, a temperature sensor, or the like. While the endless fixing belt 64 is extended among the heater roller 63, the tension roller 65, and the drive roller 66, the fixing belt 64 is endlessly moved in a counterclockwise direction in FIG. 2. During the endless movement, the back surface of the fixing belt 64 is heated by the heater roller 63.

The pressure heater roller 61 that is driven to rotate in a clockwise direction in FIG. 1 is in contact with the front surface of the fixing belt 64 at the area where the fixing belt 64 is wrapped around the heater roller 63. Thus, a fixing nip is formed, where the pressure heater roller 61 is in contact with the fixing belt 64.

A temperature sensor is provided outside the loop of the fixing belt 64 such that it is opposed to the front surface of the fixing belt 64 with a predetermined gap, and it detects the surface temperature of the fixing belt 64 just before it enters the fixing nip. The detection result is sent to a fixing power circuit. The fixing power circuit uses the detection result of the temperature sensor to perform on-off control of power supply to a heat source included in the heater roller 63 or a heat source included in the pressure heater roller 61. Thus, the surface temperature of the fixing belt 64 is kept at about 140° C.

After passing through the secondary transfer nip, the recording sheet P is separated from the intermediate transfer belt 41 and is then conveyed into the fixing unit 60. While it is nipped in the fixing nip within the fixing unit 60 and is conveyed upward in the drawing, it is heated and pressed by the fixing belt 64, whereby a full-color toner image is fixed to the recording sheet P.

After the fixing operation is performed on the recording sheet P as above, the recording sheet P is passed through the sheet discharge rollers 67 of the pair and is then discharged from the apparatus. A stack section 68 is formed on the top surface of the chassis of the printer main body, and the recording sheet P is discharged from the apparatus by the pair of sheet discharge rollers 67 and is sequentially stacked on the stack section 68.

Above the transfer unit 40 are provided four toner bottles 100Y, 100C, 100M, and 100K that are toner containers that contain Y toner, C toner, M toner, and K toner. The various color toners in the toner bottles 100Y, 100C, 100M, and 100K are appropriately supplied to the developing units 7Y, 7C, 7M, and 7K in the image forming units 1Y, 10, 1M, and 1K by the toner supply device. The toner bottles 100Y, 100C, 100M, and 100K can be attached to or removed from the printer main body separately from the image forming units 1Y, 10, 1M, and 1K.

Figure 5:
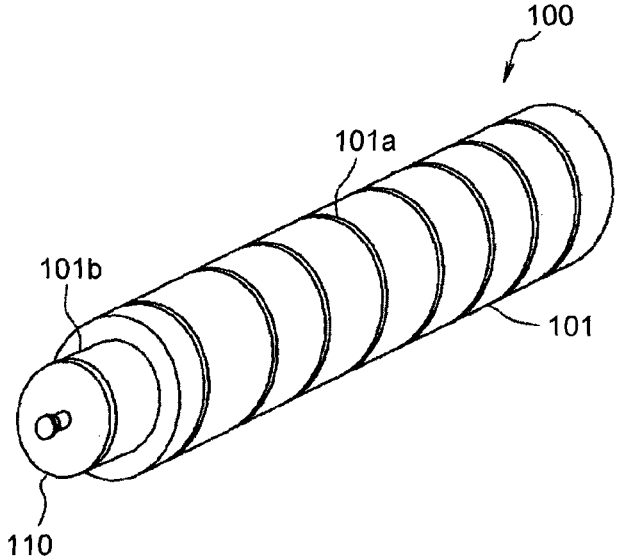
FIG. 5 is a perspective view that illustrates a toner bottle of the printer.

FIG. 5 is a perspective view that illustrates the toner bottle 100. The toner bottles 100 have the same configuration except that the colors of the toners Y, M, C, and K contained in the toner bottles 100 are different; therefore, the additional characters Y, M, C, and K that are attached to the end of the reference numerals are omitted from this drawing. The toner bottle 100 includes a cylindrical bottle main body 101 and a lid member 110. The bottle main body 101 includes a spiral groove 101*a* that is provided on the peripheral wall thereof. As the spiral groove 101*a* is embossed, it is a spiral groove when viewed from the outside of the bottle main body 101 and it is a spiral projection when viewed from the inside of the bottle main body 101.

Figure 6:
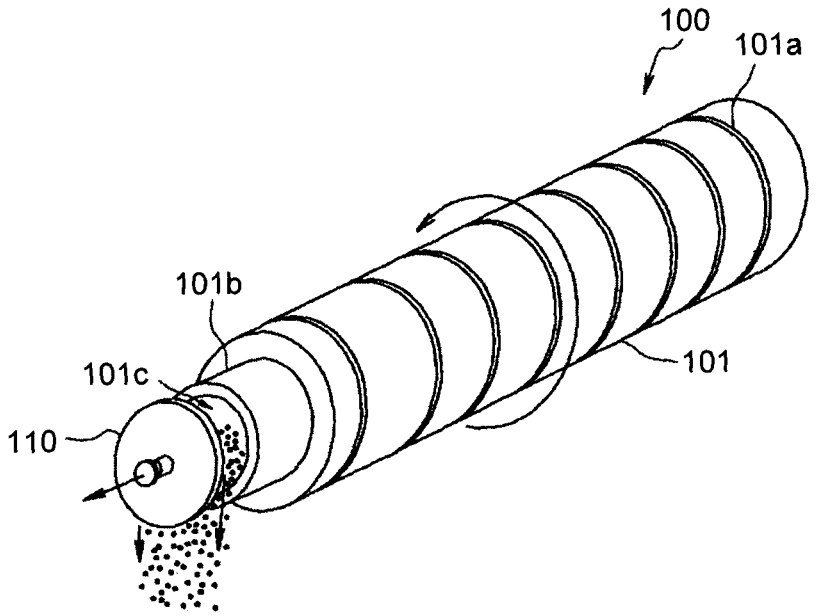
FIG. 6 is a perspective view that illustrates the toner bottle when a lid member is open.

FIG. 6 is a perspective view that illustrates the toner bottle 100 when the lid member is open. A bottle head section 101*b* is provided on one end section of the bottle main body 101 of the cylindrical toner bottle 100 in the direction of the cylinder axis line, and the bottle head section 101*b* has a diameter smaller than the other sections. A toner discharge opening 101*c* is provided on one end of the bottle head section 101*b* to discharge toner from the bottle main body 101. The toner discharge opening 101*c* is closed by the lid member 101*c* that abuts the bottle head section 101*b*. When the toner bottle 100 is attached to the toner supply device, which will be explained later, the lid member 101*c* is pulled out of the bottle head section 101*b* by the toner supply device and the toner discharge opening 101*c* is exposed and is opened. In this state, when the toner bottle 100 is driven to rotate in the direction of the arrow in the drawing by the toner supply device, the toner in the bottle main body 101 is moved from the bottle rear side toward the head side thereof due to the spiral groove 101*a* and is discharged to outside through the toner discharge opening 101*c*.

Figure 7:
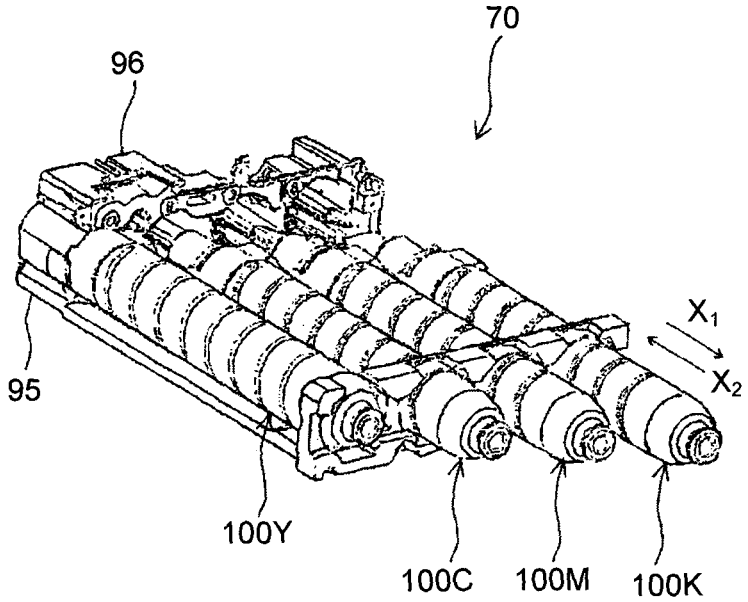
FIG. 7 is a perspective view that illustrates a toner supply device of the printer.

FIG. 7 is a perspective view that illustrates a toner supply device 70 of this printer. In this drawing, the toner supply device 70 that is a toner supply unit includes a bottle placement board 95 on which the four toner bottles 100Y, 100C, 100M, and 100K are placed; a bottle drive unit 96 that drives and rotates each of the toner bottles individually; or the like. The bottle head sections of the toner bottles 100Y, 100C, 100M, and 100K that are set on the bottle placement board 95 are inserted into the bottle drive unit 96.

When the toner bottle 100K that is attached to the bottle drive unit 96 is slid and moved on the bottle placement board 95 in a direction away from the bottle drive unit 96 as illustrated by the arrow X1 in the drawing, the bottle head section of the toner bottle 100K is removed from the bottle drive unit 96. Thus, the toner bottle 100K can be removed from the toner supply device 70.

On the other hand, in the toner supply device 70 where the toner bottle 100K is not attached, the toner bottle 100K is slid and moved on the bottle placement board 95 in a direction close to the bottle drive unit 96 as illustrated by the arrow X2 in the drawing. Then, the bottle head section of the toner bottle 100K is inserted into the bottle drive unit 96. Thus, the toner bottle 100K is attached to the toner supply device 70. The same operation is performed on the toner bottles 100Y, C, and M for the other colors, whereby they can be attached to or removed from the toner supply device 70.

Figure 8:
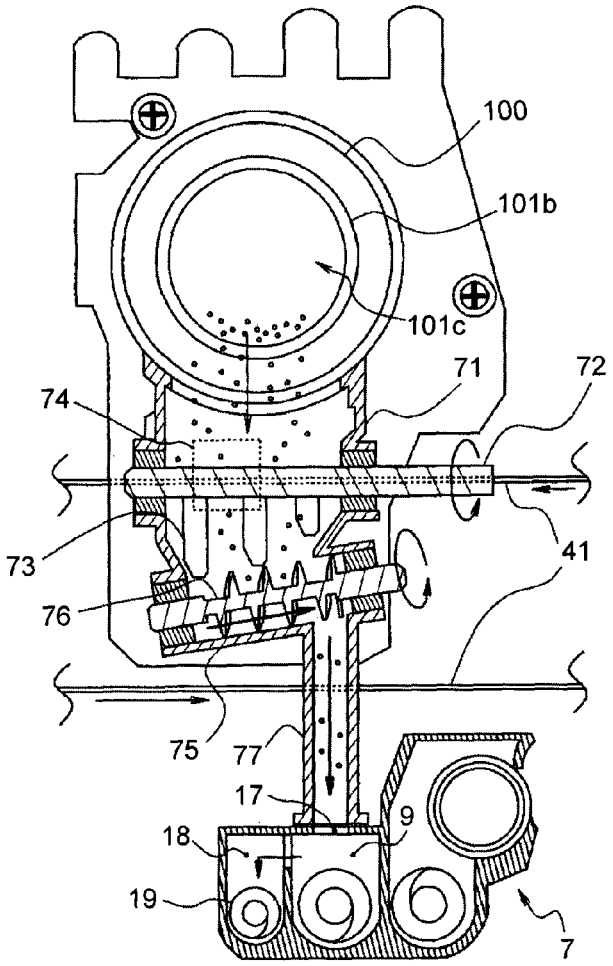
FIG. 8 is a schematic configuration diagram that illustrates a bottle main body of the toner bottle that is attached to the toner supply device and the peripheral configuration thereof.

FIG. 8 is a schematic configuration diagram that illustrates the bottle main body 101 of the toner bottle that is attached to the toner supply device and the peripheral configuration thereof. The additional characters Y, M, C, and K that are attached to the end of the reference numerals are omitted from this drawing. The bottle main body 101 of any one of the colors Y, M, C, and K and the partial area of the toner supply device are illustrated in the drawing. A hopper section 71 of the toner supply device is located just below the bottle head section 101*b* of the bottle main body 101. Toner drops through the toner discharge opening 101*c* of the bottle head section 101*b* in accordance with the rotation and driving of the bottle main body 101 and then enters the hopper section 71.

The hopper section 71 has a flat shape in a direction perpendicular to the sheet surface of the drawing and, in this drawing, it is located on the front side of the intermediate transfer belt 41. In the hopper section 71, a flexible pressing film 73 is secured to a rotary shaft member 72 that is rotatable, and the pressing film 73 is rotated together with the rotary shaft member 72. A toner detection sensor 74 is secured to the inner wall of the hopper section 71, and it includes a piezoelectric element that detects the presence or absence of toner within the hopper section 71.

The pressing film 73 includes polyethylene terephthalate (PET), and it presses toner toward the detection surface of the toner detection sensor 74 in accordance with the rotation thereof. Thus, the toner detection sensor 74 is capable of detecting the toner in the hopper section 71 in a desired manner. The control on the driving and rotation of the bottle main body 101 is performed such that the toner detection sensor 74 detects the toner in a desired manner. Therefore, as long as the bottle main body 101 contains a sufficient amount of toner, a sufficient amount of toner drops through the bottle head section 101*b* into the hopper section 71, whereby the hopper section 71 is filled with a sufficient amount of toner. If such a state changes to a state where, although the bottle main body 101 is frequently rotated, the toner detection sensor 74 is unlikely to detect the toner, a control device determines that the remaining amount of toner in the bottle main body 101 is little and notifies a user of an alarming "toner near end".

A conveying nozzle 75 is connected to the lower section of the hopper section 71, and the toner in the hopper section 71 slides down due to its own weight along the tapered surface and drops into the conveying nozzle 75. A toner supply screw 76 is provided in the conveying nozzle 75 and, in accordance with the rotational driving thereof, the toner is horizontally conveyed along the longitudinal direction of the conveying nozzle 75.

A drop guide nozzle 77 is connected to one longitudinal end of the conveying nozzle 75, and it is in a position such that it extends in a vertical direction. The lower end of the drop guide nozzle 77 is connected to a toner supply opening 17 of a first agent container 9 in a developing unit 7. When the toner supply screw 76 in the conveying nozzle 75 is rotated, the toner is carried to the longitudinal end of the conveying nozzle 75 and drops through the drop guide nozzle 77 and the toner supply opening 17 into the first agent container 9 in the developing unit 7. Thus, the toner is supplied to the first agent container 9.

Next, an explanation is given of a characteristic configuration of this printer.

Figure 9:
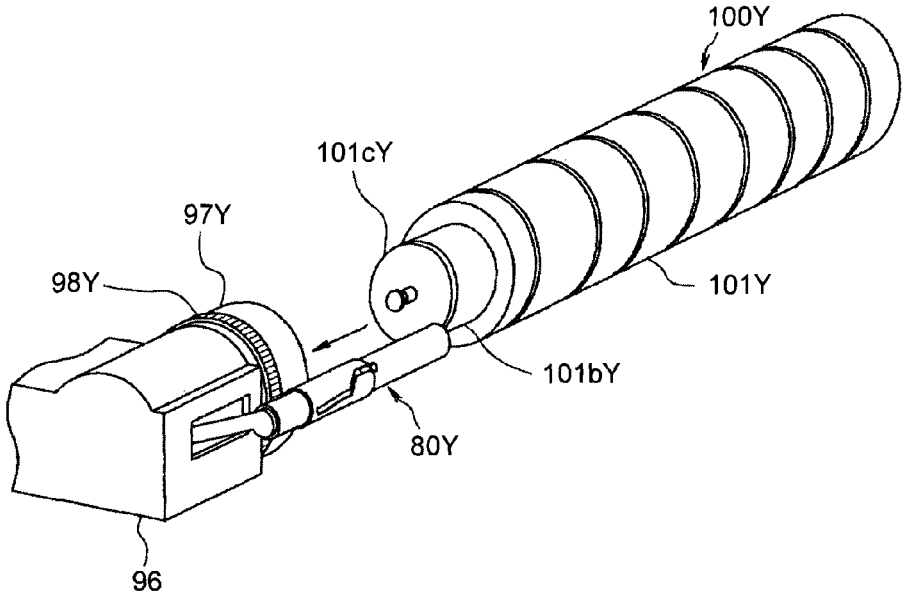
FIG. 9 is a perspective view that illustrates a Y bottle attachment section in a bottle drive unit of the toner supply device and a Y toner bottle.
Figure 10:
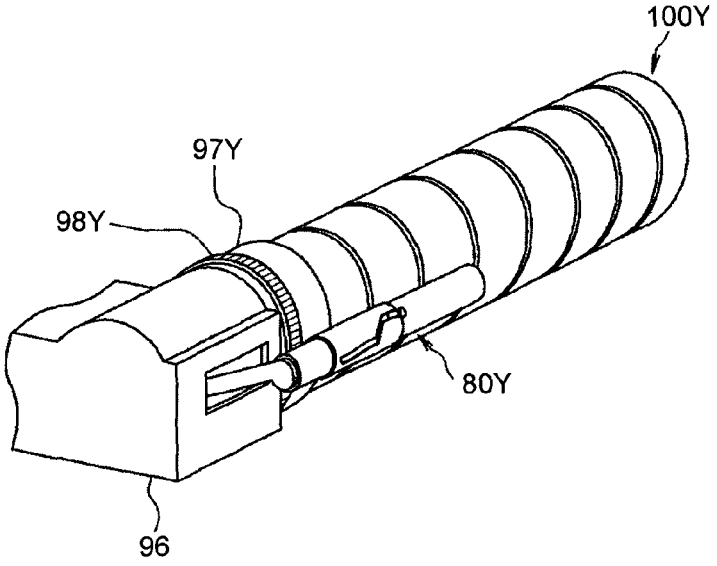
FIG. 10 is a perspective view that illustrates the Y bottle attachment section in a state where the toner bottle is attached thereto.

FIG. 9 is a perspective view that illustrates a Y bottle attachment section in the bottle drive unit 96 of the toner supply device and the Y toner bottle 101Y. The Y bottle attachment section of the bottle drive unit 96 includes a bottle holding section 97Y, a lid pulling mechanism 80Y, or the like. The bottle holding section 97Y is rotatably held by the main body of the bottle drive unit 96. A drive receiving gear 98Y is provided on the outer peripheral surface of the bottle holding section 97Y. The drive receiving gear 98Y receives a driving force while it is engaged with a drive transmission gear. Thus, the bottle holding section 97Y is driven to rotate. As illustrated by the arrow in the drawing, a bottle head section 101*b*Y of the toner bottle 100Y is attached to the bottle holding section 97Y that can be driven to rotate as above. Then, as illustrated in FIG. 10, the toner bottle 100Y is rotatably held by the main body of the bottle drive unit 96 together with the bottle holding section 97Y.

The lid pulling mechanism 80Y is provided on the bottle holding section 97Y. The lid pulling mechanism 80Y pulls a lid member 101*c*Y from the bottle head section 101*b*Y of the toner bottle 100Y so as to open the toner discharge opening 101*c* of the bottle head section 101*b*Y.

Figure 11:
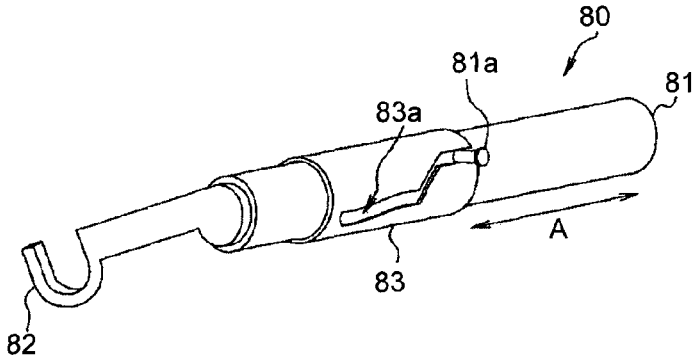
FIG. 11 is an enlarged perspective view that illustrates a lid pulling mechanism of the toner supply device.

FIG. 11 is an enlarged perspective view that illustrates a lid pulling mechanism 80. The additional characters Y, C, M, and K attached to the end of the reference numerals are omitted from the drawing. The lid pulling mechanism 80 includes a slide rod 81, a hook 82, a holding cylinder 83, or the like. The holding cylinder 83 is attached to the bottle drive unit 96 with a bracket in an immovable manner. The slide rod 81 is inserted through the holding cylinder 83, and it is held by the holding cylinder 83 such that it can slide and move in the directions of the arrow A in the drawing. The slide rod 81 is moved in the directions of the arrow A in the drawing by a drive unit. Furthermore, the direction of the arrow A in the drawing is the same as the longitudinal direction of the toner bottle.

A pin 81*a* protrudes from the peripheral surface of the slide rod 81. Furthermore, a slit 83*a* is formed on the holding cylinder 83 and extends in the directions of the arrow A, and the pin 81*a* slides and moves through the slit 83*a*. As the pin 81*a* slides and moves through the slit 83*a*, the movement of the slide rod 81 in a rod circumferential direction is restricted. In the drawing, the movement of the slide rod 81 is restricted in the rod circumferential direction such that the hook 82 is in an obliquely downward position.

Figure 12:
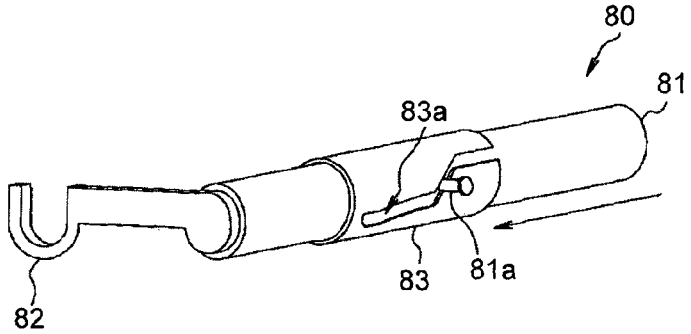
FIG. 12 is an enlarged perspective view that illustrates the lid pulling mechanism in a state where a drive rod is moved slightly forward compared to FIG. 11.

FIG. 12 is an enlarged perspective view that illustrates the lid pulling mechanism 80 in a state where the slide rod 81 is moved further forward (in the direction to attach the toner bottle) compared to FIG. 11. When the slide rod 81 is moved slightly further forward compared to the state in FIG. 11, the pin 81*a* is guided through the slit 83*a* in accordance with the above movement, and the movement of the slide rod 81 is guided in the circumferential direction; thus, the slide rod 81 is in a position such that the hook 82 extends in substantially a horizontal direction as illustrated.

Figure 13:
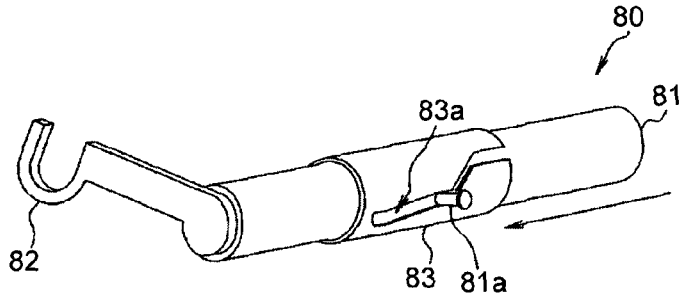
FIG. 13 is an enlarged perspective view that illustrates the lid pulling mechanism in a state where the drive rod is moved slightly forward compared to FIG. 12.

FIG. 13 is an enlarged perspective view that illustrates the lid pulling mechanism 80 in a state where the slide rod 81 is moved further forward (in the direction to attach the toner bottle) compared to FIG. 12. When the slide rod 81 is moved slightly further forward compared to the state in FIG. 12, the pin 81*a* is guided through the slit 83*a* in accordance with the above movement, and the movement of the slide rod 81 is guided in the circumferential direction; thus, the slide rod 81 is in a position such that the hook 82 faces obliquely upward as illustrated.

Figure 14:
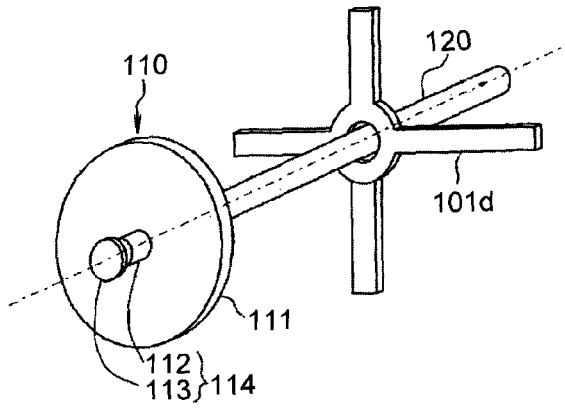
FIG. 14 is an enlarged perspective view that illustrates the lid member of the toner bottle and a rod holding member.

FIG. 14 is an enlarged perspective view that illustrates the lid member 100 of the toner bottle and a rod holding member 101*d*. In this drawing, the rod holding member 101*d* is secured to the inner wall of the bottle main body 101. Furthermore, the dashed-dotted line in the drawing indicates the cylinder central axis line of the toner bottle. As illustrated, while the lid member 110 is in close contact with the bottle head section, the lid member 110 is in a position such that the central axis line of the disk-shaped lid member 110 meets the cylinder central axis line of the toner bottle.

The lid member 110 includes a disk-shaped lid main body 111; a handle section 114 that protrudes from the center of the front surface of the lid main body 111 toward the front side of the bottle (the outside of the bottle); and a guide rod 120 that protrudes from the center of the back surface of the lid main body toward the rear side of the bottle (the inside of the bottle). Furthermore, the handle section 114 includes a rod-like section 112 that protrudes toward the front side of the bottle, i.e., in a direction in which the lid member is pulled out; and a large-diameter section 113 that is provided on an end section of the rod-like section 112.

The rod holding member 101*d* is attached to the inner peripheral surface of the bottle main body, and it includes a holding hole, i.e., a through-hole, that is located at the cylinder central axis line of the toner bottle and, as the guide rod 120 of the lid member 110 is received within the holding hole, it holds the lid member 110 in a movable manner.

Figure 15:
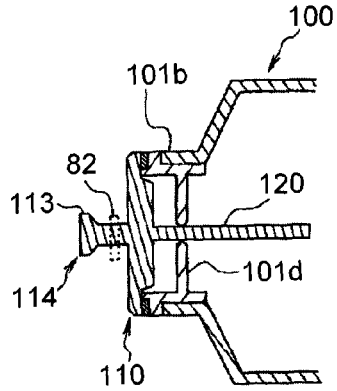
FIG. 15 is an enlarged cross-sectional view that illustrates a bottle head section of the toner bottle.

In accordance with the movements in FIGS. 11 and 12, the lid pulling mechanism 80 pulls and moves the lid member 110 in a direction toward the front side of the bottle while the hook 82 is engaged with the large-diameter section 113 of the handle section 114 of the lid member 110. Thus, the lid member 110, which abuts the bottle head section of the toner bottle, is pulled out of the bottle head section. Specifically, in FIG. 11, the slide rod 81 of the lid pulling mechanism 80 is in a home position in a slide movement direction. In this state, the hook 82 is just about to be engaged with the large-diameter section 113 of the handle section 114 of the lid member 110 that abuts the bottle head section 101*b*, as illustrated in FIG. 15.

Figure 16:
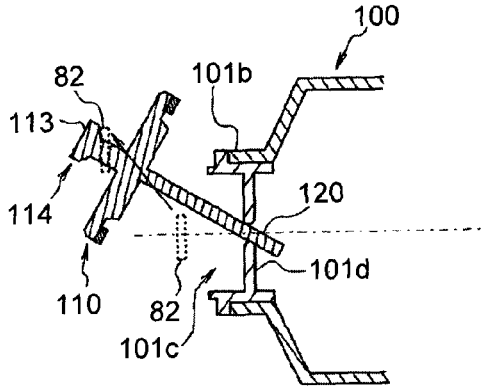
FIG. 16 is an enlarged cross-sectional view that illustrates the bottle head section in a state where the lid member is pulled out.

While the above state changes to the state in FIG. 12 where the slide rod 81 of the lid pulling mechanism 80 is moved slightly forward in the drawing (in the direction to attach the toner bottle), the hook member 82 is moved obliquely upward (in the direction of the arrow) with respect to the cylinder central axis line (virtual line), which is indicated by the dashed-dotted line, of the bottle as illustrated in FIG. 16. Then, while it is engaged with the large-diameter section 113 of the lid member 110, it pulls out the lid member 110 from the bottle head section 101*b* in a direction inclined upward with respect to the cylinder central axis line (in the direction of the arrow).

Figure 17:
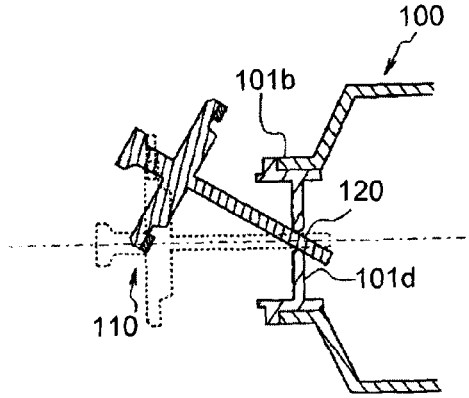
FIG. 17 is an enlarged cross-sectional view that illustrates the bottle head section in the above state as well as the conventionally configured lid in an opened state.

The lid member 110 is pulled out as above; therefore, the lid member 110 is in an obliquely upward position as illustrated in the drawing. Thus, the size of the clearance that exists between the toner discharge opening 101*c* of the bottle head section 101*b* and the lid member 110 pulled out of the bottle head section 101*c* is not the same in a vertical direction. With regard to the entire area of the clearance in the vertical direction, the area in the lower end section through which toner passes is larger than the area in the upper end section through which air passes. Thus, it is possible to obtain a sufficient distance between the toner discharge opening 101*c* and the lid member 110 in the area of the lower end section where toner passes through, thereby discharging the toner in a desired manner. Furthermore, in the area of the upper end section where toner does not pass through, the distance between the toner discharge opening 101*c* and the lid member 110 is decreased, and intake of air is reduced; thus, it is possible to prevent the occurrence of spread of toner from the bottle head section 101*b* to the outside of the container. It is obvious that, compared to a case where the lid member 110 is pulled out straight along the cylinder central axis line in the same manner as a conventional case, as illustrated by the dotted line in FIG. 17, the distance between the lid member 110 and the bottle head section 101*b* in the area of the upper end section is significantly reduced.

Figure 18:
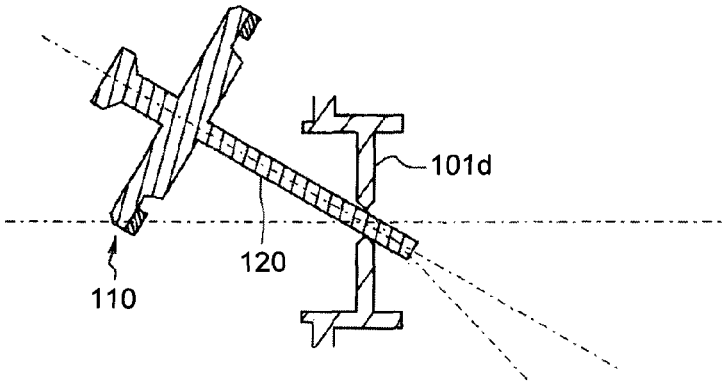
FIG. 18 is a partially enlarged cross-sectional view that illustrates the lid member as well as the rod holding member.

As illustrated in FIG. 18, while the lid member 110 is pulled out of the bottle head section 101*b* obliquely upward, the guide rod 120 is in an inclined position, the guide rod 120 protruding from the back surface of the lid member 110 toward the rear side of the bottle. In order to allow the guide rod 120 to be in an inclined position, a certain degree of clearance is provided between the guide rod 120 and the holding hole of the rod holding member 101*d* that holds the guide rod 120 in a slidable manner.

Figure 19:
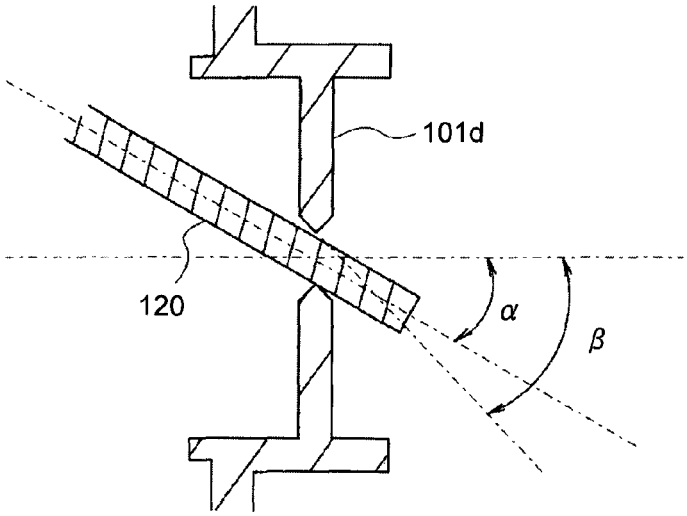
FIG. 19 is an enlarged cross-sectional view that illustrates a first example of a taper around the holding hole of the rod holding member.
Figure 20:
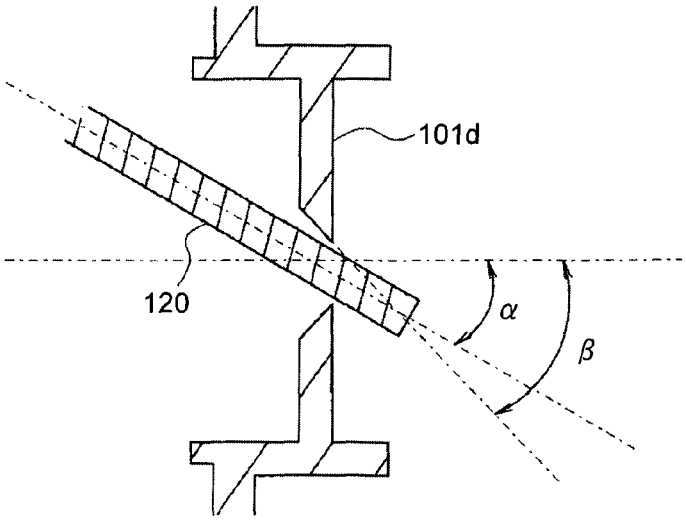
FIG. 20 is an enlarged cross-sectional view that illustrates a second example of the taper around the holding hole of the rod holding member.
Figure 21:
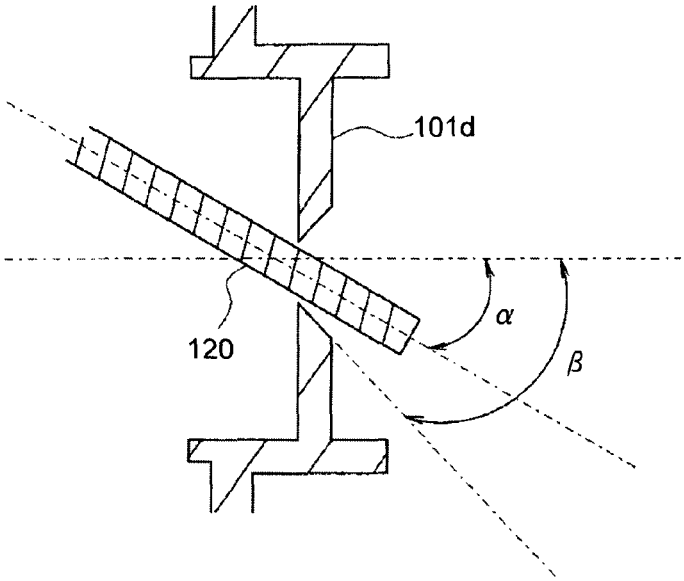
FIG. 21 is an enlarged cross-sectional view that illustrates a third example of the taper around the holding hole of the rod holding member.

FIG. 19 is an enlarged configuration diagram that illustrates a first example of the taper that is provided around the holding hole of the rod holding member 101*d*. Furthermore, FIG. 20 is an enlarged configuration diagram that illustrates a second example of the taper that is provided around the holding hole of the rod holding member 101*d*. Moreover, FIG. 21 is an enlarged configuration diagram that illustrates a third example of the taper that is provided around the holding hole of the rod holding member 101*d*. In any of the examples, the angle β of the taper with respect to the cylinder central axis line is larger than the angle α at which the lid member 110 is pulled out. With the provision of the taper, the diameter of the holding hole can be reduced to some extent so as to prevent backlash of the guide rod 120 while the guide rod 120 can be in an inclined position within the holding hole at the pulling angle α.

Figure 22:
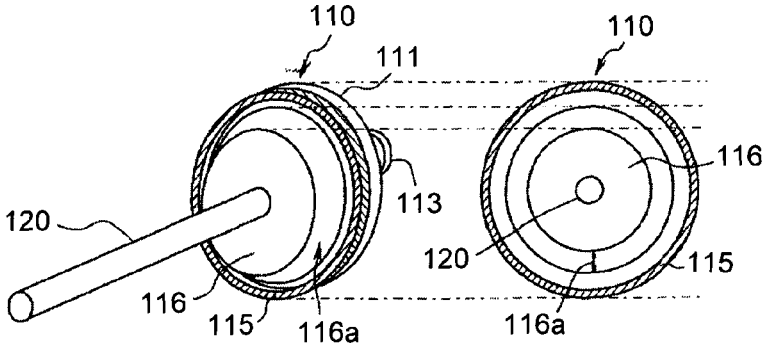
FIG. 22 is a perspective view and a back view of the lid member when viewed from the back side thereof.

FIG. 22 is a perspective view and a back view of the lid member 110 when viewed from the back side thereof. On the back surface of the lid main body 111 of the lid member 110 is provided a ring-shaped sealing member 115 that has substantially the same outer diameter as that of the lid main body 111 and that is constituted by a sponge, or the like. Furthermore, on the back surface of the lid main body 111 is provided a cylindrical (specifically, truncated cone-shaped) plug member 116 that protrudes in a direction along which the lid member 110 is pulled back (to the rear side of the bottle).

Figure 23:
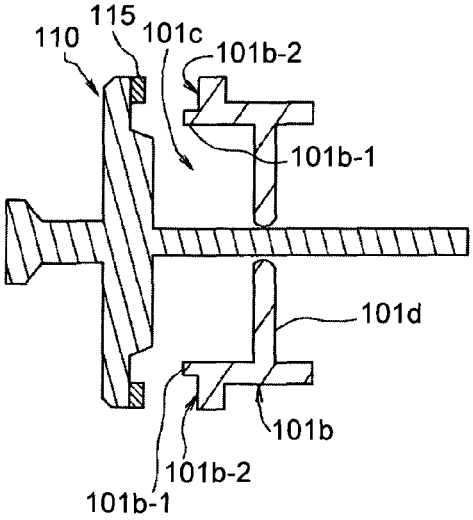
FIG. 23 is an enlarged cross-sectional view that illustrates the bottle head section and the lid member that is pulled out therefrom.
Figure 24:
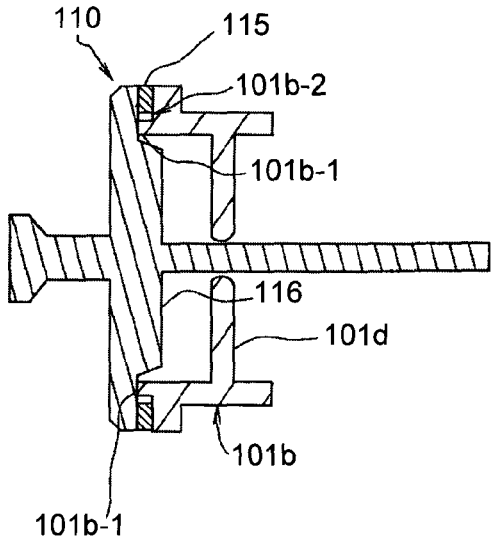
FIG. 24 is an enlarged cross-sectional view that illustrates the bottle head section and the lid member that is in contact therewith.

FIG. 23 is an enlarged cross-sectional view that illustrates the bottle head section 101*b* and the lid member 110 that is pulled out therefrom. Furthermore, FIG. 24 is an enlarged cross-sectional view that illustrates the bottle head section 101*b* and the lid member 110 that is in contact therewith. On the bottle head section 101*b* is provided a ring-shaped protrusion 101*b*-1 that encloses the toner discharge opening 101*c*, and the ring-shaped protrusion 101*b*-1 rises from a ring-shaped edge surface 101*b*-2 of the bottle head section 101*b*. The ring-shaped edge surface 101*b*-2 is located closer to the outer periphery compared to the ring-shaped protrusion 101*b*-1.

While the lid member 110 is in contact with the bottle head section 101*b* so as to close the toner discharge opening 101*c*, the ring-shaped sealing member 110 of the lid member 110 is in contact with the edge surface 101*b*-2 of the bottle head section 101*b* and is elastically deformed. Thus, the sealing performance for the toner discharge opening 101*c* is secured, and it is ensured that the spread of toner through the toner discharge opening 101*c* to the outside of the bottle is prevented. Furthermore, when the lid member 110 is in contact with the bottle head section 101*b*, the plug member 116 is located inside the toner discharge opening 101*c* within the bottle head section 101*b*, the plug member 16 protruding from the back surface of the lid main body 111 toward the rear side of the bottle.

Figure 25:
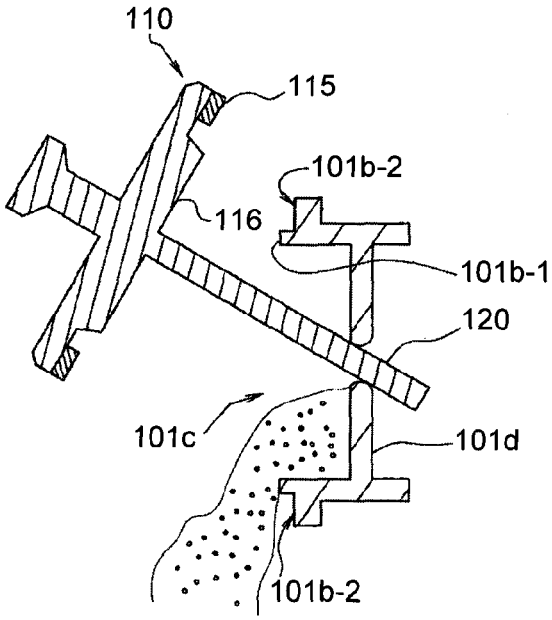
FIG. 25 is a cross-sectional view that illustrates the behavior of toner through the toner discharge opening.

FIG. 25 is a cross-sectional view that illustrates the behavior of toner that is discharged through the toner discharge opening 101*c*. As illustrated in the drawing, when toner is discharged through the toner discharge opening 101*c* of the bottle head section 101*b*, the toner is discharged through the toner discharge opening 101*c* such that it falls from the edge of the ring-shaped protrusion 101*b*-1 that is, in the bottle head section 101*b*, located closest to the end of the bottle. At that time, as toner is brought into contact with the ring-shaped protrusion 101*b*-1, a large amount of toner adheres to it. However, as the edge surface 101*b*-2 is located on the rear side of the bottle compared to the ring-shaped protrusion 101*b*-1, toner is not brought into contact with the edge surface 101*b*-2. As toner is not brought into contact with the edge surface 101*b*-2 that is in contact with the sealing member 115 when the lid member 110 abuts the bottle head section 101*b*, it is possible to prevent a decrease in the sealing performance that is caused by the interposition of toner, which adheres to the edge surface 101*b*-2, between the edge surface 101*b*-2 and the sealing member 115.

Figure 26:
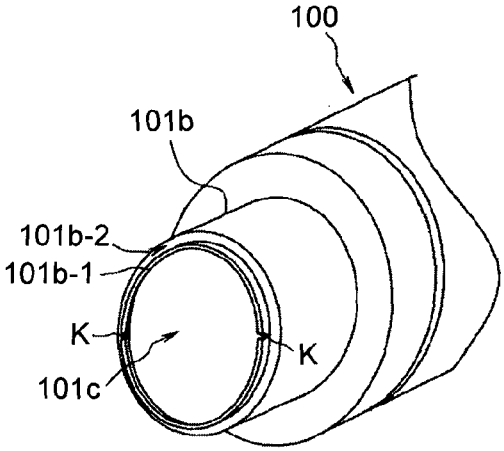
FIG. 26 is an enlarged perspective view that illustrates the bottle head section.

FIG. 26 is an enlarged perspective view that illustrates the bottle head section 101*b*. A notch K is provided at a predetermined position on the entire area of the ring-shaped protrusion 101*b*-1 of the bottle head section 101*b* in a circumferential direction. When the lid member 110 is in contact with the bottle head section 101*b*, the notch K allows air to move in and out of the toner bottle 100 while it is sealed for the toner. Specifically, the air in the toner bottle 100 can move out of the bottle through the notch K and the sealing member (115 in FIG. 24). The sealing member is constituted by a porous material, such as a sponge, and the diameter of a pore is smaller than that of the toner; therefore, it allows only the air to pass through. Furthermore, air outside the toner bottle 100 can enter the toner bottle 100 through the sealing member and the notch K. As described above, the toner sealing performance is provided while the passage of air is enabled; thus, the atmospheric pressure within the toner bottle 100 can be kept constant.

Assume that, when the toner bottle 100 is driven to rotate, the lid member 110 is not rotated together with the toner bottle 100 and only the bottle main body 101 is rotated, the hook being engaged with the handle section 114. Thus, the guide rod 120 that is not rotating slides on the inner wall of the holding hole of the rod holding member 101*d*, and there is a possibility that toner is rubbed at the sliding area and the generation of clumps of toner is facilitated. Therefore, in this printer, the lid member 110 that is pulled out, of the bottle head section 101*b* is rotated together with the bottle main body of the toner bottle 100.

Figure 27:
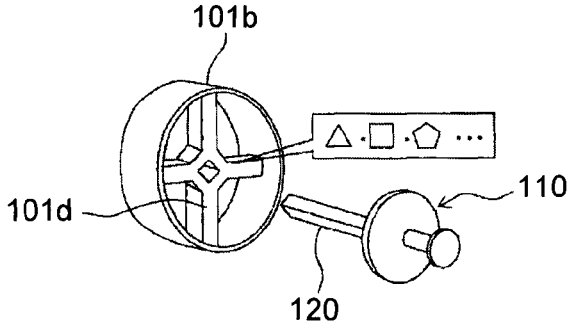
FIG. 27 is a perspective view that illustrates the bottle head section and the lid member.

FIG. 27 is a perspective view that illustrates the bottle head section 101*b* and the lid member 110. As illustrated in the drawing, a diamond shape is used as the planar shape of the holding hole of the rod holding member 101*d*. Furthermore, the guide rod 120 that has a diamond shape in cross-section is used as illustrated in the drawing. It is obvious that the cross-sectional surface of the guide rod 120 is smaller than the holding hole of the rod holding member 101*d*. If both the planar shape of the holding hole and the cross-sectional shape of the guide rod 120 are circular, the rod holding member 101*d* spins around the guide rod 120, the rod holding member 101*d* being driven to rotate together with the bottle main body 101. Conversely, as in this printer, if both the planar shape of the holding hole and the cross-sectional shape of the guide rod 120 are diamond-shaped, the edge of the cross-sectional surface of the guide rod 120 is stuck on the inner wall of the holding hole so that the guide rod 120 as well as the lid member 110 can rotate together with the bottle main body. The planar shape of the holding hole and the cross-sectional shape of the guide rod 120 are not limited to a diamond shape. If they have a polygonal shape, the same effect can be produced as with the diamond shape. Furthermore, the planar shape of the hole of a receiving section and the cross-sectional shape of the guide rod 120 may be different polygonal shapes.

Figure 28:
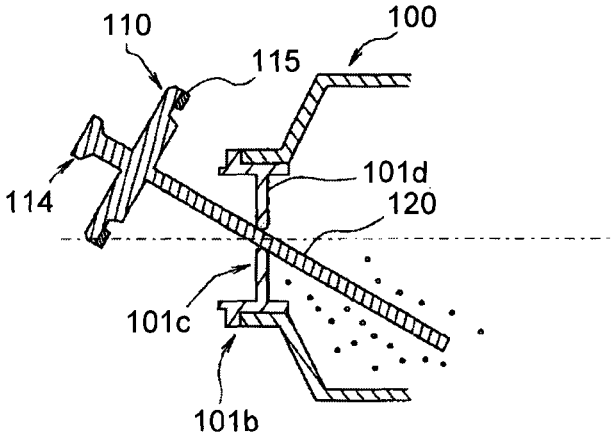
FIG. 28 is a cross-sectional view that illustrates the behavior of a guide rod that stirs toner.

It is preferable that the length of the guide rod 120 is set to be a value such that, while the lid member 110 is open obliquely with respect to the bottle head section 101*b*, the end section of the guide rod 120 is located below the cylinder central axis line, as illustrated in FIG. 28. This allows the end section of the guide rod 120 to stir the toner in the toner bottle 100 in accordance with the rotational driving of the toner bottle 100.

Figure 29:
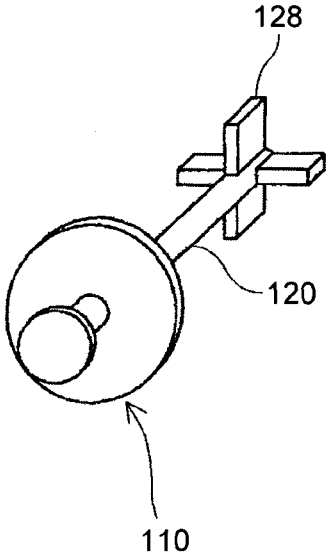
FIG. 29 is a perspective view that illustrates the lid member 110 that includes the guide rod that has a stirring paddle formed on an end section thereof.
Figure 30:
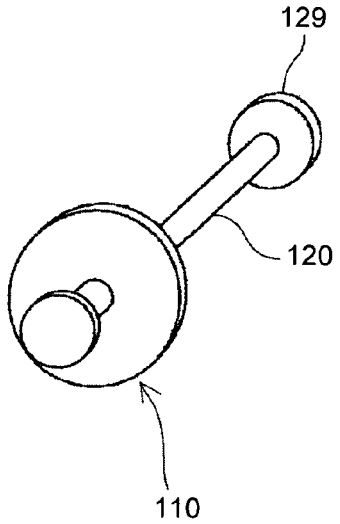
FIG. 30 is a perspective view that illustrates the lid member 110 that includes the guide rod that has a stirring blade formed on an end section thereof.

It is preferable that a blade member that facilitates toner stirring, such as a stirring paddle 128 illustrated in FIG. 29 or a stirring blade 129 illustrated in FIG. 30, is provided on the end section of the guide rod 120. Thus, it is possible to stir the toner by using the guide rod 120 in a more effective way.

Figure 31:
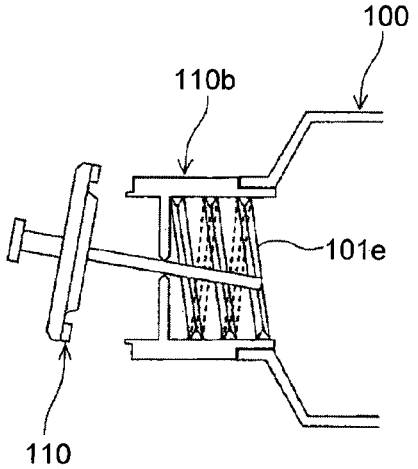
FIG. 31 is an enlarged configuration diagram that illustrates the bottle head section that has a spiral groove formed on the inner peripheral surface thereof.

Furthermore, as illustrated in FIG. 31, it is preferable that a helical projection is provided on the inner peripheral surface of the bottle head section 101*b*. This facilitates the discharge of toner from the bottle head section 101*b* so as to prevent accumulation of toner in the bottle head section 101*b*.

Figure 32:
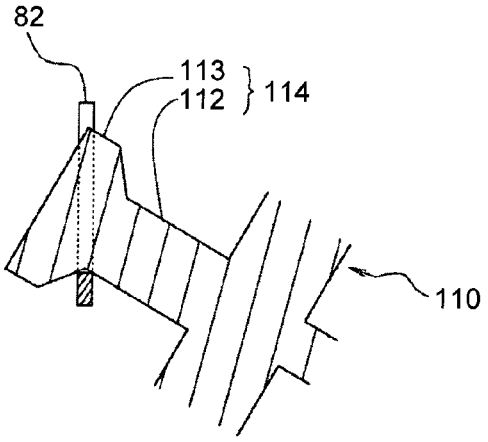
FIG. 32 is an enlarged cross-sectional view that illustrates the large-diameter section 113 that has a taper formed on the rear end section thereof.
Figure 33:
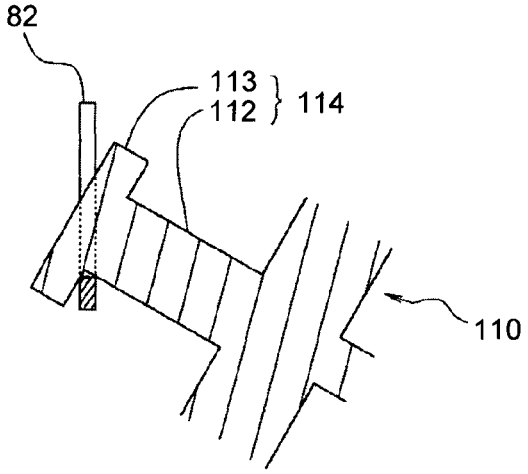
FIG. 33 is an enlarged cross-sectional view that illustrates a handle section in a comparative example.

Furthermore, as illustrated in FIG. 32, it is preferable that a taper is provided on the boundary area between the large-diameter section 113 and the rod-like section 112 of the handle section 114 that is provided on the end of the lid member 110 and the diameter of the taper is gradually increased from the rear end side of the lid member 110 toward the leading end thereof. If such a taper is not provided, the boundary area between the peripheral surface of the rod-like section 112 of the handle section 114 and the large-diameter section 113 has an angle of substantially 90 [°], as illustrated in FIG. 33. The hook 82 of the lid pulling mechanism is interposed between the peripheral surface and the back surface (the surface of the large-diameter section 113 closer to the rod-like section 112) that form an angle of 90 [°], where one of the edges is in contact with the peripheral surface and the other one of the edges is in contact with the back surface. In such a state, the frictional resistance between the edge and the peripheral surface or the back surface is extremely increased and thus the drive load is increased.

Conversely, as illustrated in FIG. 32, if a taper is provided on the boundary area between the large-diameter section 113 and the rod-like section 112, the angle formed by the taper and the peripheral surface of the rod-like section 1120 is larger than 90 [°]. Then, the frictional resistance is reduced between the taper or the peripheral surface and the edge of the hook 82 that is interposed between the taper and the peripheral surface that form the above large angle. Thus, the drive load can be further decreased.

Figure 34:
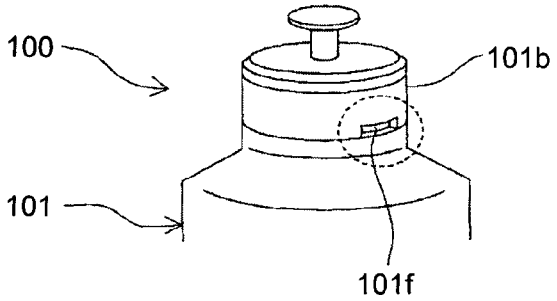
FIG. 34 is an enlarged perspective view that illustrates the bottle head section 101*b*.
Figure 35:
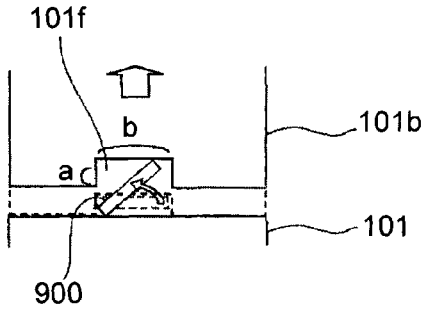
FIG. 35 is an enlarged side view that illustrates the bottle head section 101*b*.

As illustrated in FIG. 34, the bottle head section 101*b* is engaged with the bottle main body 101. Specifically, after the bottle head section 101*b* and the bottle main body 101 are separately molded, they are engaged with each other. A jig insertion groove 101*f* for inserting a jig is provided at the boundary between the bottle main body 101 and the bottle head section 101*b* on the outer peripheral surface thereof. As illustrated in FIG. 35, the length b of the jig insertion groove 101*f* in the direction of the bottle transverse plane is longer than the length a thereof in the direction of the bottle axis line. A jig 900 is inserted into the jig insertion groove 101*f* and is rotated, whereby the bottle head section 101*b* can be easily removed from the bottle main body 101.

Next, an explanation is given of a printer according to each example where a more characteristic configuration is added to the printer of the embodiment. Furthermore, the configuration of the printer according to each example is the same as that according to the present embodiment if not otherwise specified below.

First Example

Figure 36:
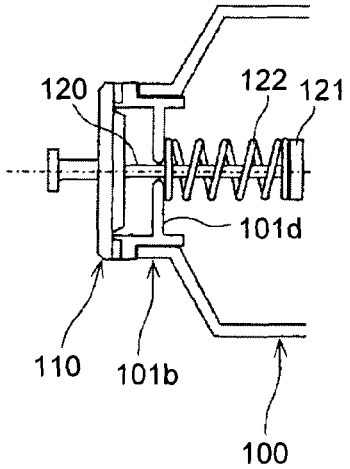
FIG. 36 is an enlarged configuration diagram that illustrates the bottle head section with which the lid member is in contact in a printer according to a first example.
Figure 37:
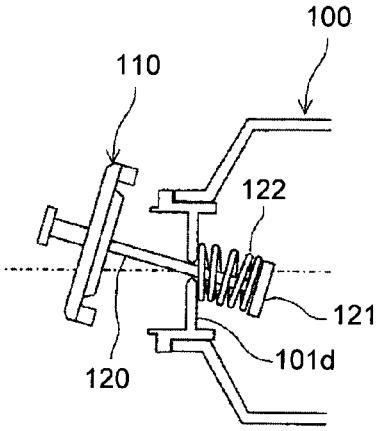
FIG. 37 is an enlarged configuration diagram that illustrates the bottle head section from which the lid member is pulled out in the printer.

FIG. 36 is an enlarged configuration diagram that illustrates the bottle head section 101*b* with which the lid member 110 is in contact in a printer according to a first example. Furthermore, FIG. 37 is an enlarged configuration diagram that illustrates the bottle head section 101*b* from which the lid member 110 is pulled out in the printer according to the first example. In these figures, a spring receiving member 121 is secured to the rear end of the guide rod 120. Furthermore, the guide rod 120 has a coil spring 122 interposed between the spring receiving member 121 and the rod holding member 101*d*.

As illustrated in FIG. 37, when the lid member 110 is pulled out of the bottle head section 101*b*, the distance between the rod holding member 101*d* and the spring receiving member 121 that is provided on the rear end of the guide rod 120 is decreased and thus the coil spring 122 is compressed. While the lid member 110 is in contact with the bottle head section 101*b*, it is in a position such that it exists along the cylinder central axis line of the toner bottle 100, as illustrated in FIG. 36. Therefore, when the coil spring 122 is compressed as illustrated in FIG. 37, the coil spring 122 pulls back the lid member 110 toward the bottle head section 101*b* and returns the lid member 110, which is in an inclined position with respect to the cylinder central axis line, to a position along the cylinder central axis line. However, when the hook of the lid pulling mechanism remains at a position to open the lid member 110, the hook prevents the lid member 110 from being pulled back. When the lid pulling mechanism moves a drive rod so as to retract the hook (moves it in a direction opposite to the direction to attach the toner bottle), the lid member 110 is forcibly pulled back to a position where it abuts the bottle head section 101*b* due to the restoring force of the coil spring 122, and the position of the lid member 110 is corrected to a straight position along the cylinder central axis line.

As described above, the coil spring 122, which is a position returning unit, forcibly pulls the lid member 110 back to a position where it is in contact with the bottle head section 101*b* and forcibly sets its position in a straight position; thus, the configuration of the lid puling mechanism can be simplified. Specifically, even if a high accuracy is not set for an operation performed by the lid pulling mechanism to close the lid member 110, the lid member 110 can be properly brought into contact with the bottle head section 101*b*; therefore, it is possible to simplify the configuration of the lid pulling mechanism without setting a high operation accuracy thereof.

When the coil spring 122 pulls the lid member 110 back, the guide rod 120 slides and moves through the holding hole of the rod holding member 101*d*, whereby it is possible to support the lid member 110 so as to return to its original straight position.

Figure 38:
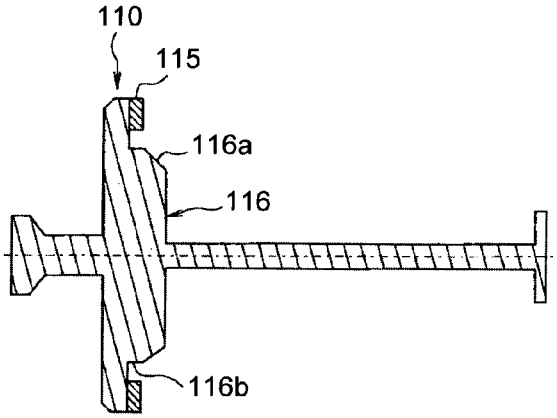
FIG. 38 is a longitudinal sectional view that illustrates the lid member.

FIG. 38 is a longitudinal sectional view that illustrates the lid member 110. A tapered surface 116*a* is provided on the outer edge portion, in a normal direction, of the cylindrical (more specifically, truncated cone-shaped) plug member 116 of the lid member 110, and the tapered surface 116*a* gradually decreases the height of the plug member 116 from the circle center side of the disk-shaped lid member 110 toward the outside thereof. Furthermore, the diameter of the outer edge of the tapered surface 116*a* is the same as that of the rising portion of the plug member 116 that rises from the back surface of the lid member 110, and a linear stepped section 116*b* is provided at the position therebetween in the direction of the cylinder axis line.

Figure 39:
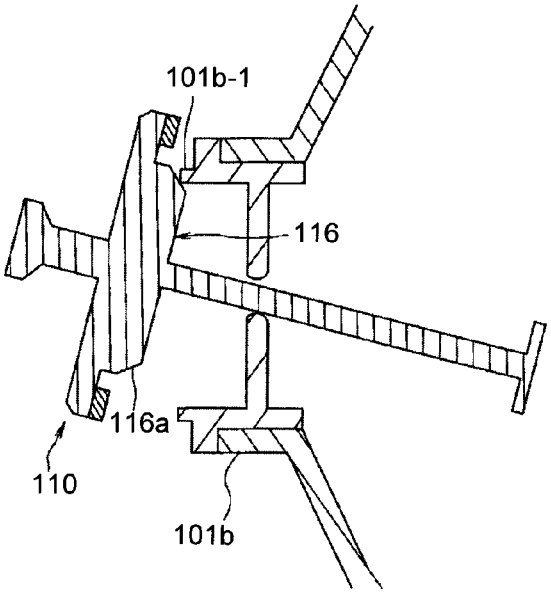
FIG. 39 is a cross-sectional view that illustrates an example of the state of the lid member while it is being closed on the bottle head section.

FIG. 39 is a cross-sectional view that illustrates an example of the state of the lid member 110 while it is being closed on the bottle head section 101*b*. For convenience, the illustration of the coil spring 122 is omitted from the drawing. While the lid member 110 is being pulled back to a position where it is in contact with the bottle head section 101*b* due to the force of the coil spring, the lid member 110 sometimes reaches the contact position before its inclined position becomes adequately a straight position. In such a situation, as illustrated in the drawing, the tapered surface 116*a* of the plug member 116 comes into contact with the ring-shaped protrusion 101*b*-1 of the bottle head section 101*b* so that the position of the lid member 101 is corrected to a straight position. Thus, it is possible to ensure that the lid member 110 is brought into contact with the bottle head section 101*b* without being misaligned.

Figure 40:
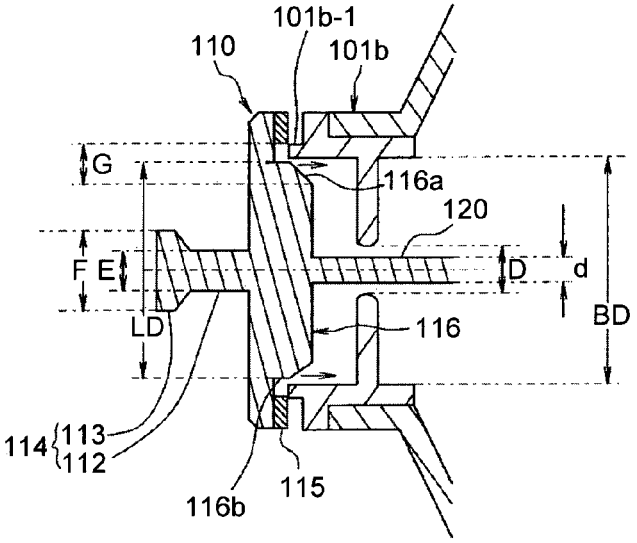
FIG. 40 is an enlarged cross-sectional view that illustrates the bottle head section just before the lid member is brought into contact with it.

As illustrated in FIG. 40, just before the lid member 110 is completely in contact with the bottle head section 101*b*, the surface of the stepped section 116*b* of the plug member 116 is brought into contact with the inner wall of the ring-shaped protrusion 101*b*-1 of the bottle head section 101*b*. As both the surface of the stepped section 116*b* and the surface of the ring-shaped protrusion 101*b* extend in the direction of a cylinder axis line (the dashed-dotted line), the stepped section 116*b* guides the plug member 116 so as to move it within the ring-shaped protrusion 101*b*-1 in the direction of a cylinder axis line from the leading end side of the bottle toward the rear end side thereof. Thus, just before the lid member 110 is completely in contact with the bottle head section 101*b*, the lid member 110 is guided straight in the direction of a cylinder axis line from the leading end side of the bottle toward the rear end side thereof and is brought into contact with the bottle head section 101*b* in an accurate manner.

In this figure, D represents the holding-hole inner diameter that is the inner diameter of the holding hole that is an opening for holding the rod holding member 101*d*. Furthermore, d represents the rod outer diameter that is the outer diameter of the guide rod 120. Furthermore, BD represents the ring-protrusion inner diameter that is the inner diameter of the ring-shaped protrusion 101*b*-1. Furthermore, LD represents the plug outer diameter that is the outer diameter of the plug member 116. Furthermore, G represents ½ of the difference between the inner diameter of the sealing member and the inner diameter of the plug member 116. Furthermore, E represents the rod outer diameter that is the outer diameter of the rod-like section 112 of the handle section 114. Moreover, F represents the large outer diameter that is the outer diameter of the large-diameter section 113 of the handle section 114.

In this printer, the difference between the holding-hole inner diameter D and the rod outer diameter d is equal to or less than the difference (G×2 in the drawing) between the inner diameter of the taper 116*a* of the plug member 116 and the outer diameter of the sealing member 115 ($D-d \leq G$). With this configuration, as illustrated in FIG. 39, while the lid member 110 is being closed, it is ensured that the tapered surface 116*a* of the plug member 116 comes into contact with the ring-shaped protrusion 101*b*-1 of the bottle head section 101*b*, and the position of the lid member 110 can be corrected to a straight position.

Furthermore, in this printer, the difference between the ring-protrusion inner diameter BD and the plug-member outer diameter LD is less than the difference between the large outer diameter F and the rod outer diameter E ($\phi BD-\phi LD<F$). With this configuration, when the toner bottle 100 is attached, it is possible to prevent the large-diameter section 113 of the handle section 114 of the lid member 110 from being engaged with the hook of the lid pulling mechanism, and it is possible to ensure that the toner bottle 100 is inserted into the bottle drive unit.

Furthermore, the difference between the plug outer diameter LD and the inner diameter of the sealing member 115 (the clearance between the plug member 116 and the sealing member 115) is about 2 to 3 mm.

Second Example

Figure 41:
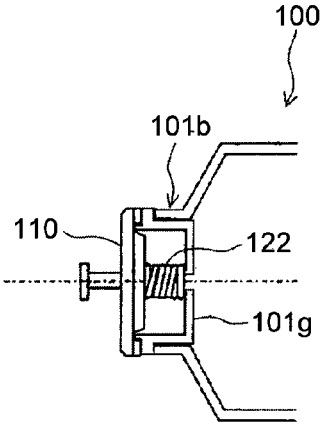
FIG. 41 is an enlarged configuration diagram that illustrates the bottle head section in a state where it is in contact with the lid member of the toner bottle in a printer according to a second example.
Figure 42:
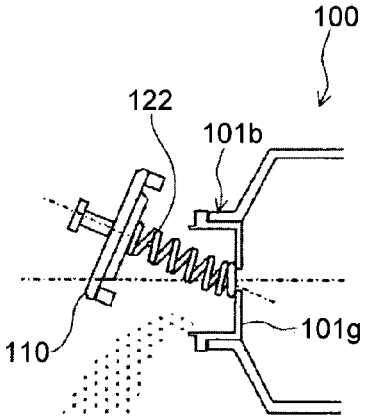
FIG. 42 is an enlarged configuration diagram that illustrates the bottle head section in a state where the lid member of the toner bottle is open in the printer.

FIG. 41 is an enlarged configuration diagram that illustrates the bottle head section 101*b* in a state where it is in contact with the lid member 110 of the toner bottle 100 in a printer according to a second example. Furthermore, FIG. 42 is an enlarged configuration diagram that illustrates the bottle head section 101*b* in a state where the lid member 110 of the toner bottle 100 is open in the printer. In the printer according to the second example, a guide rod is not provided in the lid member 110. Furthermore, a rod holding member is not provided inside the bottle head section 101*b*. Instead, a spring holding member 101*g* is provided inside the bottle head section 101*b*. Moreover, one end of the coil spring 122 is secured to the back surface of the lid member 110, and the other end of the coil spring 122 is secured to the spring holding member 101*g*.

With this configuration, the combination of the coil spring 122 and the spring holding member 101*g* serves as a position returning unit that returns the lid member 110, which is pulled out of the bottle head section 101*b* and is in an inclined position with respect to a cylinder central axis line, to a position along the cylinder central axis line. In this printer, the coil spring 122 applies, to the lid member 110 that abuts the bottle head section 101*b*, a force to pull it toward the bottle head section 101*b* along the cylinder central axis line (the dashed-dotted line in the drawing). Furthermore, when the coil spring 122 is bent while the lid member 110 is pulled out of the bottle head section 101*b* and is in an inclined position with respect to the cylinder central axis line, the coil spring 122 applies, to the lid member 110, a force to correct the lid member 110 into a position along the cylinder central axis line (a restoring force of the coil spring 122). Thus, the inclined lid member 100 is connected to the bottle head section 101*b* in a straight state. With this configuration, it is possible to open/close the lid member 110 in a desired manner even though the length of the bottle head section 101*b* becomes relatively long in the direction of a cylinder central axis line.

Figure 43:
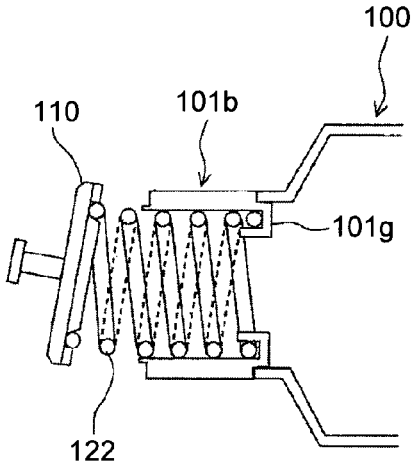
FIG. 43 is an enlarged configuration diagram that illustrates the bottle head section according to a modified example of the printer of the second example.

FIG. 43 is an enlarged configuration diagram that illustrates the bottle head section 101*b* according to a modified example of the printer of the second example. The coil spring 122 that is used in this modified example has an outer diameter that is substantially the same as the inner diameter of the bottle head section 101*b*. With this configuration, as illustrated in the drawing, when the lid member 110 is pulled out of the bottle head section 101*b* so that the coil spring 122 extends, the shape of the coil spring 122 is changed into a helical shape. This helical shape can facilitate the movement of toner in the bottle head section 101*b* toward the toner discharge opening in the direction of the axis line. Thus, it is possible to prevent the accumulation of toner within the bottle head section 101*b* without providing a helical protrusion on the inner peripheral surface of the bottle head section 101*b*.

Third Example

Figure 44:
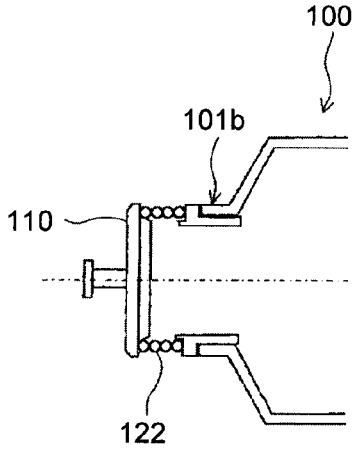
FIG. 44 is an enlarged configuration diagram that illustrates the bottle head section in a state where it is in contact with the lid member of the toner bottle in a printer according to a third example.
Figure 45:
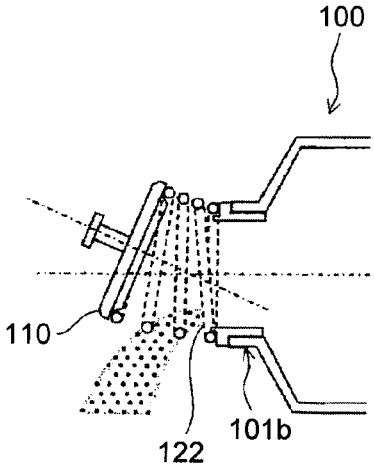
FIG. 45 is an enlarged configuration diagram that illustrates the bottle head section in a state where the lid member of the toner bottle in the printer is open.

FIG. 44 is an enlarged configuration diagram that illustrates the bottle head section 101*b* in a state where it is in contact with the lid member 110 of the toner bottle 100 in a printer according to a third example. Furthermore, FIG. 45 is an enlarged configuration diagram that illustrates the bottle head section 101*b* in a state where the lid member 110 of the toner bottle 100 in the printer is open. In the printer according to the third example is used the coil spring 122 that has substantially the same outer diameter as that of the bottle head section 101*b*. Furthermore, the spring holding member is not provided inside the bottle head section 101*b*. Moreover, the leading end of the coil spring 122 is secured to the back surface of the lid member 110, and the rear end of the coil spring 122 is secured to the edge surface of the bottle head section 101.

With this configuration, while the lid member 110 is closed, the coil spring 122 serves as part of the bottle head section 101*b*, as illustrated in FIG. 44. As illustrated in FIG. 45, while the lid member 110 is open, toner is discharged through the gap between the coils of the coil spring 122. As the coil spring 122 serves as part of the bottle head section 101*b*, it is possible to make the bottle head section 101*b* longer at low costs.

Fourth Example

Figure 46:
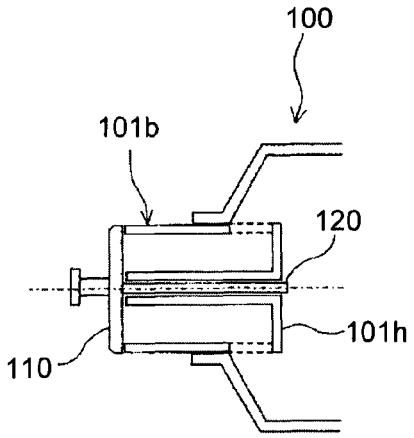
FIG. 46 is an enlarged configuration diagram that illustrates the bottle head section in a state where it is in contact with the lid member of the toner bottle in a printer according to a fourth example.
Figure 47:
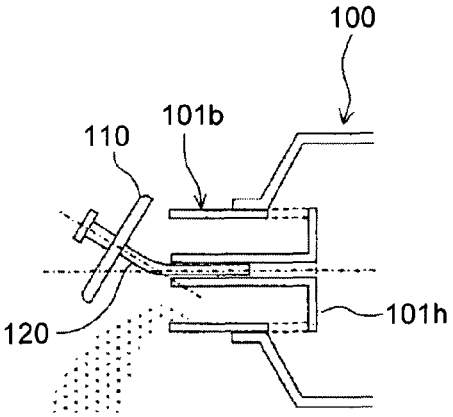
FIG. 47 is an enlarged configuration diagram that illustrates the bottle head section in a state where the lid member of the toner bottle in the printer is open.

FIG. 46 is an enlarged configuration diagram that illustrates the bottle head section 101*b* in a state where it is in contact with the lid member 110 of the toner bottle 100 in a printer according to a fourth example. Furthermore, FIG. 47 is an enlarged configuration diagram that illustrates the bottle head section 101*b* in a state where the lid member 110 of the toner bottle 100 in the printer is open. In the printer according to the fourth example, a rod holding member 101*h* is provided within the bottle head section 101*b*, and the rod holding member 101*h* includes a cylindrical pin receiving section. The guide rod 120 of the lid member 110 is inserted into the cylindrical receiving section of the rod holding member 101*h* and is slid for movement through the receiving section in a cylinder longitudinal direction.

Furthermore, the guide rod 120 is formed of a flexible material. Therefore, when the lid member 110 is pulled out of the bottle head section 101*b* in a state where it is inclined with respect to the cylinder central axis line, the part of the guide rod 120 that protrudes from the rod holding member 101*h* is bent obliquely with respect to the direction of the cylinder axis line. Due to this bending, an oblique movement of the lid member 110 is allowed, and the guide rod 120 applies, to the lid member 110, a force to correct the lid member 110 to a straight position along the direction of the cylinder central axis line. With this configuration, the combination of the guide rod 120 and the rod holding member 101*h* serves as a position returning unit. Without the provision of a coil spring, it is possible to correct the position of the lid member 110 to a straight position when it is brought into contact with the bottle head section 101*b*.

Figure 48:
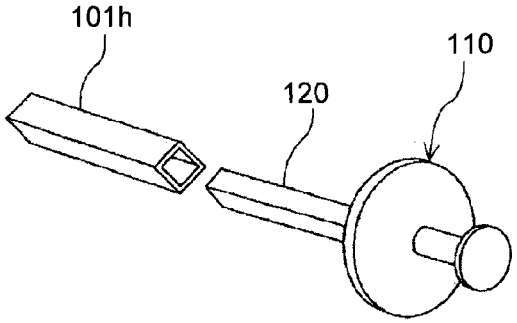
FIG. 48 is a perspective view that illustrates the bottle head section and the lid member of the toner bottle in the printer according to the fourth example.

FIG. 48 is a perspective view that illustrates the bottle head section 101*b* and the lid member 110 of the toner bottle in the printer according to the fourth example. A diamond shape is used as the planar shape of the hole of the pin receiving section of the rod holding member 101*h*, as illustrated in the drawing. Furthermore, the guide rod 120 that has a diamond shape in cross-section is used as illustrated in the drawing. It is obvious that the cross-sectional surface of the guide rod 120 is smaller than the hole of the pin receiving section of the rod holding member 101*h*. If both the planar shape of the hole and the cross-sectional shape of the guide rod 120 are circular, the rod holding member 101*h*, which is driven to rotate together with the bottle main body, spins around the guide rod 120. Conversely, as in this printer, if both the planar shape of the hole and the cross-sectional shape of the guide rod 120 are diamond-shaped, the edge (corner section) of the cross-sectional surface of the guide rod 120 is stuck on the inner wall or corner section of the hole so that the guide rod 120 and the lid member 110 can be rotated together with the bottle main body. The planar shape of the holding hole and the cross-sectional shape of the guide rod 120 are not limited to a diamond shape. If it has a polygonal shape, the same effect can be produced as with the diamond shape. Furthermore, the planar shape of the hole of the receiving section and the cross-sectional shape of the guide rod 120 may be different polygonal shapes.

Figure 49:
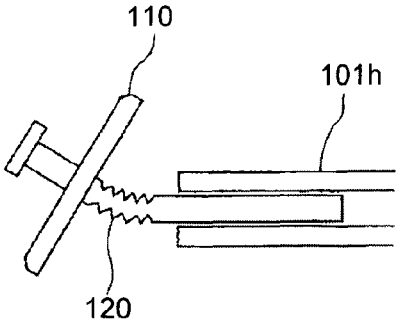
FIG. 49 is an enlarged configuration diagram that illustrates the lid member and the rod holding member according to a first modified example of the printer of the fourth example.

FIG. 49 is an enlarged configuration diagram that illustrates the lid member 110 and the rod holding member 101*h* according to a first modified example of the printer of the fourth example. In the first modified example, the guide rod 120 that has a bellows-like shape is used. The guide rod 120 can be flexibly bent because of the bellows-like shape. With this configuration, because of the bellows-like shape of the guide rod 120, it is possible to apply, to the lid member 110 that is pulled out of the bottle head section 101*b*, a force to correct its position to a straight position.

Figure 50:
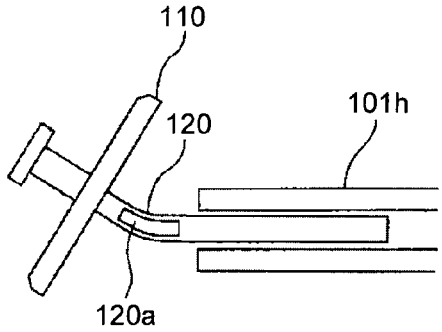
FIG. 50 is an enlarged configuration diagram that illustrates the lid member and the rod holding member according to a second modified example of the printer of the fourth example.
Figure 51:
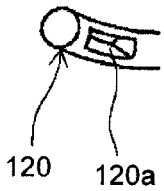
FIG. 51 is a perspective view that illustrates a guide rod according to the second modified example.

FIG. 50 is an enlarged configuration diagram that illustrates the lid member 110 and the rod holding member 101*h* according to a second modified example of the printer of the fourth example. Furthermore, FIG. 51 is a perspective view that illustrates a guide rod according to the second modified example. In the printer according to the second modified example, the guide rod 120 that is formed of a material that has a relatively high degree of hardness is used. If the guide rod 120 has a simple pin-like shape, it is difficult to bend it at a straight position. However, a hollow 120*a* is provided in the guide rod 120 in the printer according to the fourth example, as illustrated in the drawing. As illustrated in FIG. 50, the hollow allows the guide rod 120 to bend flexibly. With this configuration, if a material that has a high degree of hardness needs to be used for the material of the guide rod 120 for some reason, it is possible to bend the guide rod 120 flexibly and make the guide rod 120 serve as part of the position returning unit.

Figure 52:
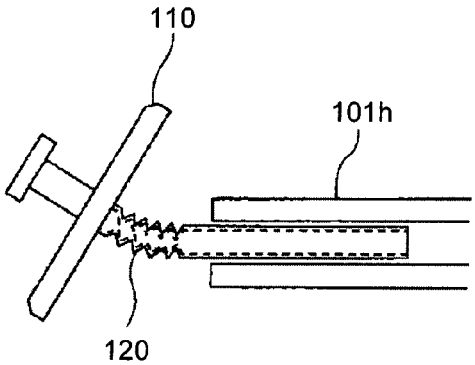
FIG. 52 is an enlarged configuration diagram that illustrates the lid member and the rod holding member according to a third modified example of the printer of the fourth example.

FIG. 52 is an enlarged configuration diagram that illustrates the lid member 110 and the rod holding member 101*h* according to a third modified example of the printer of the fourth example. In the printer according to the third modified example, a stretchable material is used for the guide rod 120. Due to the stretching force, the guide rod 120 can bend flexibly as illustrated in the drawing and can serve as part of the position returning unit.

Figure 53:
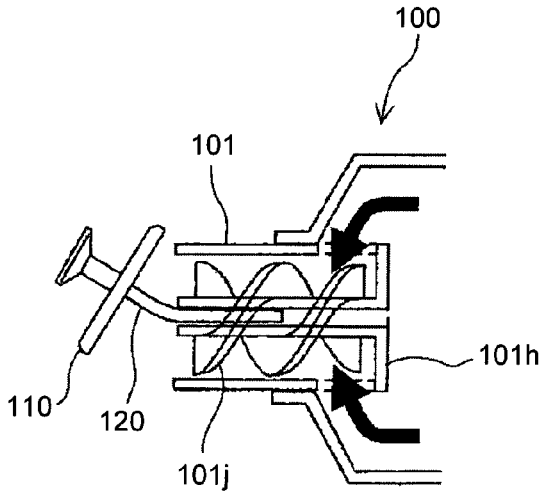
FIG. 53 is an enlarged configuration diagram that illustrates the bottle head section according to a fourth modified example of the printer of the fourth example.
Figure 54:
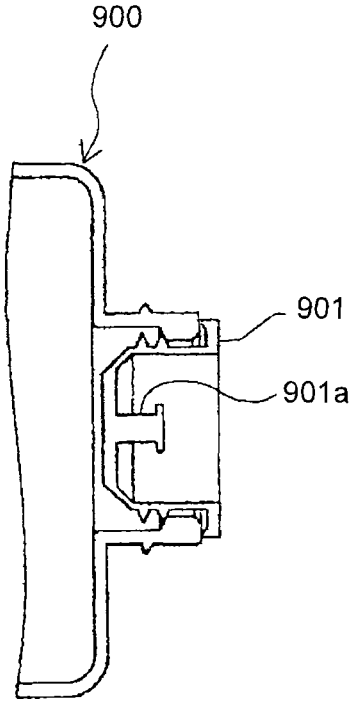
FIG.54 BACKGROUND ART
FIG. 54 is a cross-sectional view that illustrates a head section of a toner container that is attached to the toner supply unit described in Patent Literature 1.
Figure 55:
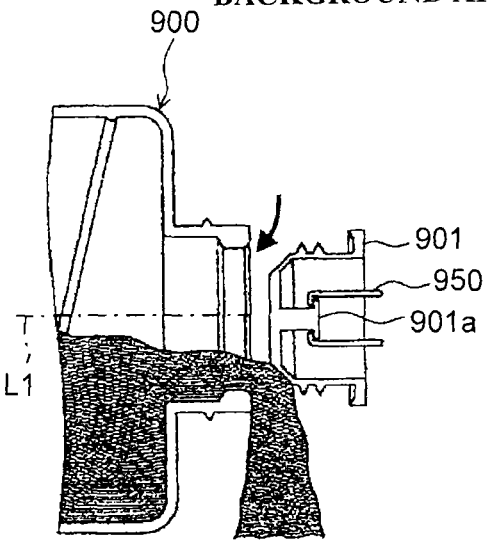
FIG.55 BACKGROUND ART
FIG. 55 is a cross-sectional view that illustrates the head section in a state where a lid member is open.

FIG. 53 is an enlarged configuration diagram that illustrates the bottle head section 101*b* according to a fourth modified example of the printer of the fourth example. In the printer according to the fourth modified example, a screw blade 101*j* is provided, in a standing manner, on the outer peripheral surface of the pin receiving section of the rod holding member 101*h*. When the toner bottle 100 is driven to rotate, the screw blade 101*j* rotates together with the bottle main body and the rod holding member 101*h*. Due to the rotation, toner in the bottle head section 101*b* is carried toward the toner discharge opening 101*c*.

With this configuration, assume that the toner bottle 100 is stored for a long period with the bottle head section 101*b* facing downward in the direction of gravitational force. Furthermore, assume that toner is in a compressed state within the bottle head section 101*b*. Even in such a state, it is possible to discharge the compressed toner from the bottle head section 101*b* by using the screw blade 101*j* during an initial operation.

Furthermore, the screw blade 101 may be provided on the part of the guide rod 120 that protrudes from the pin receiving section, instead of the outer peripheral surface of the pin receiving section of the rod holding member 101*h*.

Fifth Example

In this example, an explanation is given of a configuration for preventing the toner bottle 100 from being improperly attached to the toner supply device 70 (printer).

Furthermore, the configuration for preventing the toner bottle 100 from being improperly attached to the toner supply device 70 (printer), which is explained in this example, can be preferably applied to the above-described first to fourth examples.

First, an explanation is given of the problem with a fifth example.

Figure 67:
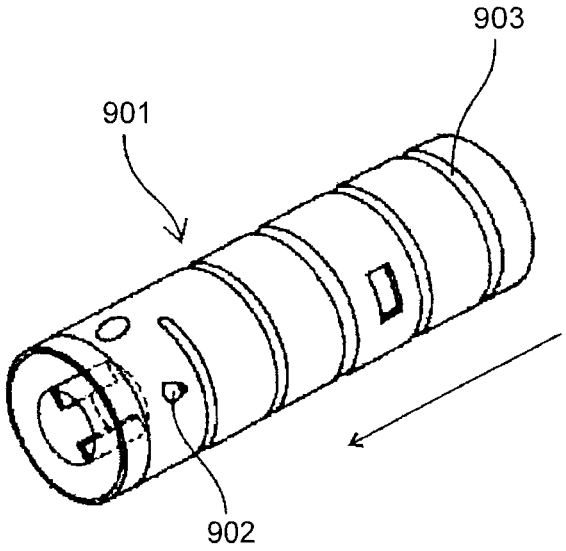
FIG.67 BACKGROUND ART
FIG. 67 is a perspective view that illustrates a toner bottle that is attached to a toner supply device that is described in Patent Literature 2.

Conventionally, the toner supply device that is described in Patent Literature 2 (Japanese Patent Application Laid-open No. 10-48935) is known as a toner supply unit that is installed in this type of image forming apparatus. FIG. 67 is a perspective view that illustrates a toner bottle 901 that is a toner container that is attached to the toner supply device described in Patent Literature 2. In this figure, the cylindrical toner bottle 901 includes a spiral groove 903 on its peripheral wall. As the groove 903 is formed to be embossed, it is a spiral groove when viewed from the outside of the container and it is a helical projection when viewed from the inside of the container. When the toner bottle 901 is driven to rotate about a cylinder central axis line by a drive unit, toner in the container is conveyed in the direction of the arrow in the drawing from the rear end side of the container toward the leading end side thereof due to the movement of the groove 903. It is then discharged from the container through a toner discharge opening that is provided on the end section of the container.

Figure 68:
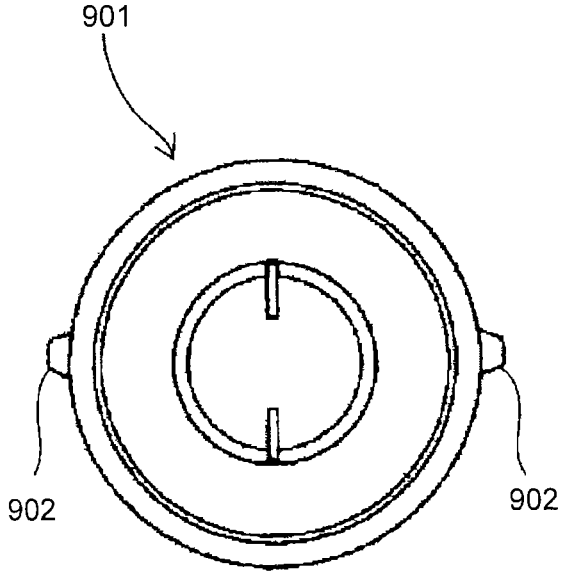
FIG.68 BACKGROUND ART
FIG. 68 is a front view that illustrates the toner bottle.
Figure 69:
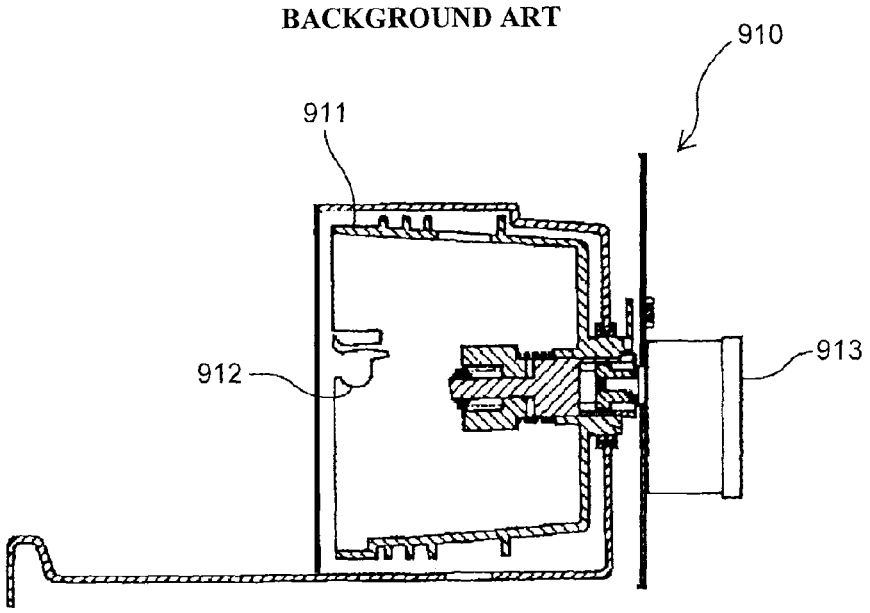
FIG.69 BACKGROUND ART
FIG. 69 is a relevant-part configuration diagram that illustrates the relevant part of the toner supply device.
Figure 70:
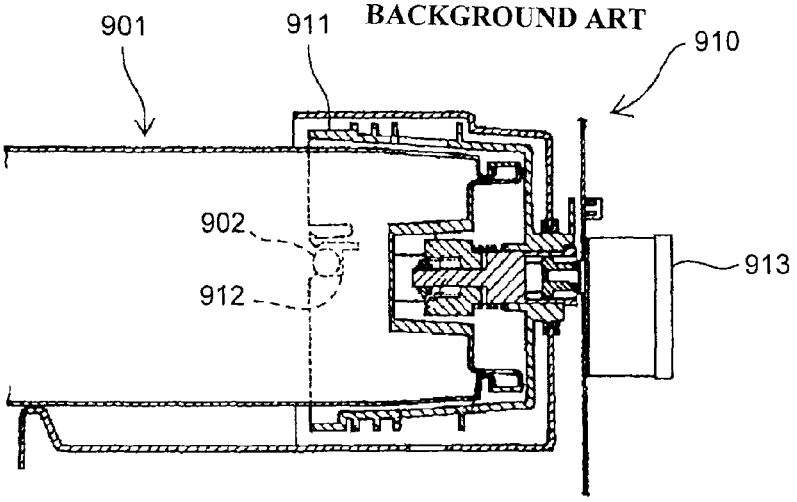
FIG.70 BACKGROUND ART
FIG. 70 is a relevant-part configuration diagram that illustrates the relevant part in a state where a toner bottle is attached.

On the end section of the toner bottle 901 is provided a peripheral protrusion 902 that protrudes from the outer peripheral surface in a normal direction. As illustrated in FIG. 68, the peripheral protrusions 902 are provided on the outer peripheral surface of the toner bottle 901 at the positions that are point-symmetric with respect to the cylinder central axis line. FIG. 69 is a relevant-part configuration diagram that illustrates the relevant part of a toner supply device 910 that is described in Patent Literature 2. The toner supply device 910 includes a cap-like coupling 911 that is rotatably supported; a drive motor 913 that drives and rotates the coupling 911; or the like. The coupling 911 is provided such that its opening faces in a horizontal direction as illustrated in the drawing, and it includes an engagement cutout 912 on its peripheral wall. As illustrated in FIG. 70, the end section of the toner bottle 901 is inserted into the coupling 911. Here, the peripheral protrusion 902 of the toner bottle 901 is engaged with the engagement cutout 912 of the coupling 911. When the coupling 911 is driven to rotate due to driving of the drive motor 913, the toner bottle 901 is driven to rotate together with the coupling 911 while it receives the rotative force of the coupling 911, the peripheral protrusion 902 being engaged with the engagement cutout of the coupling 911. As the toner bottle 901 is driven to rotate as above, toner in the bottle can be conveyed toward the toner discharge opening on the end section of the bottle.

However, when an operator inserts the toner bottle 901 into the coupling 911 in the toner supply device 910, the operator needs to adjust the position of the toner bottle 901 with respect to the coupling 911 in a rotation direction; thus, it is time-consuming to make the position adjustment. Specifically, as illustrated in FIG. 68, the two peripheral protrusions 902 are provided on the peripheral surface of the toner bottle 901. Furthermore, although FIG. 69 illustrates only the single engagement cutout 912 into which the peripheral protrusion 902 is inserted, an engagement cutout is actually provided on the peripheral wall of the coupling 911 at the position that is point-symmetric with respect to the illustrated engagement cutout 912. In order to insert the two peripheral protrusions 902 of the toner bottle 901 into the two engagement cutouts 912, the operator needs to make the following position adjustment before pushing the toner bottle 901, which is placed on the toner supply device 910, toward the coupling 911. Specifically, the position adjustment is to, while the toner bottle 901 is manually rotated, adjust the positions of the two peripheral protrusions 902 of the toner bottle 901 to the two engagement cutouts 912 of the coupling 911 in a rotation direction. It is time-consuming for an operator to make the position adjustment.

Figure 56:
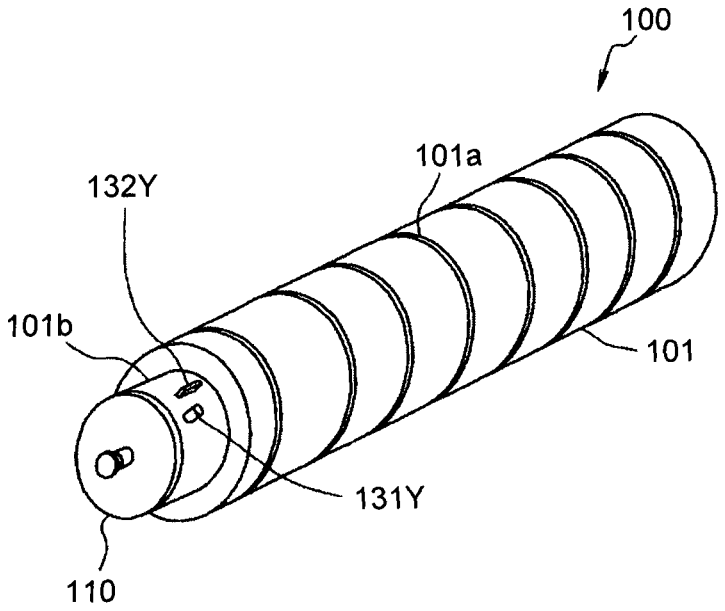
FIG. 56 is a perspective view that illustrates the toner bottle according to a fifth example.
Figure 57:
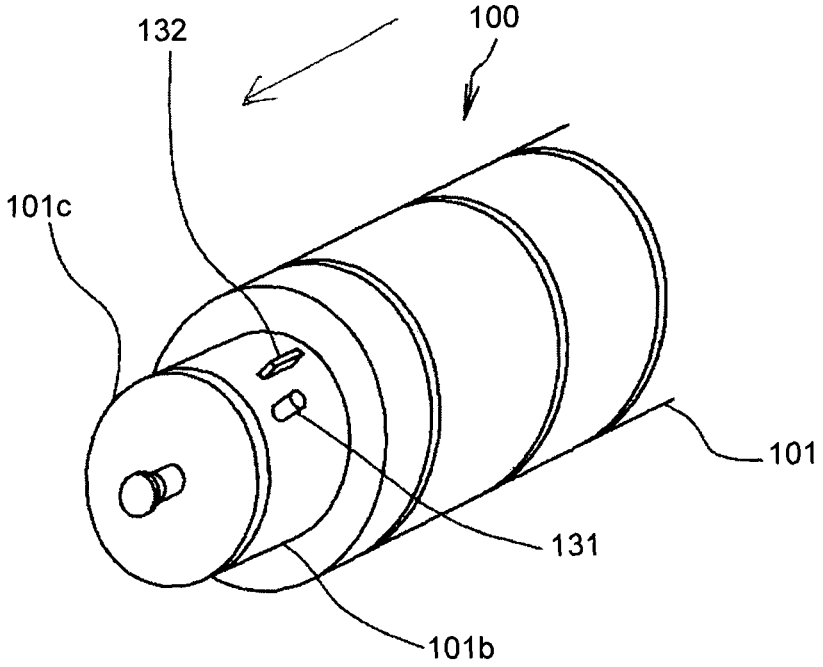
FIG. 57 is an enlarged perspective view that illustrates the bottle head section of the toner bottle of FIG. 56 in an enlarged manner.

Next, an explanation is given of a configuration of this printer. FIG. 56 is a perspective view that illustrates the toner bottle 100 according to the present example. FIG. 57 is an enlarged perspective view that illustrates the bottle head section 101*b* of the toner bottle 100 in an enlarged manner.

Figure 58:
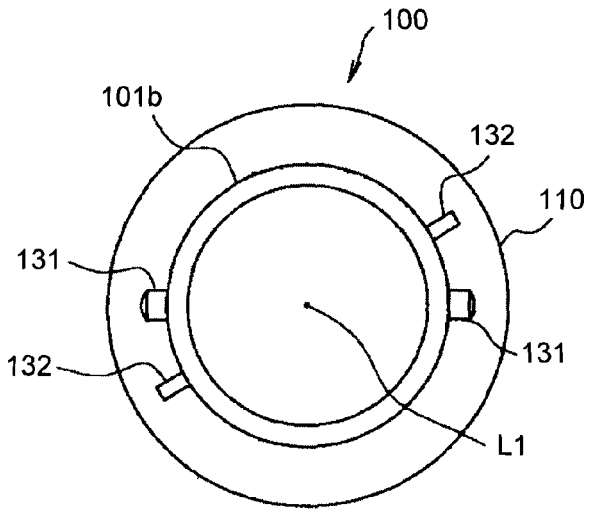
FIG. 58 is a front view that illustrates the toner bottle.

As illustrated in the drawing, on the bottle head section 101*b* is provided a peripheral protrusion 131 that protrudes from the outer peripheral surface in, a normal direction. As illustrated in FIG. 58, the peripheral protrusions 131 are provided on the outer peripheral surface of the bottle head section 101*b* at the positions that are point-symmetric with respect to a cylinder central axis line L1.

Figure 59:
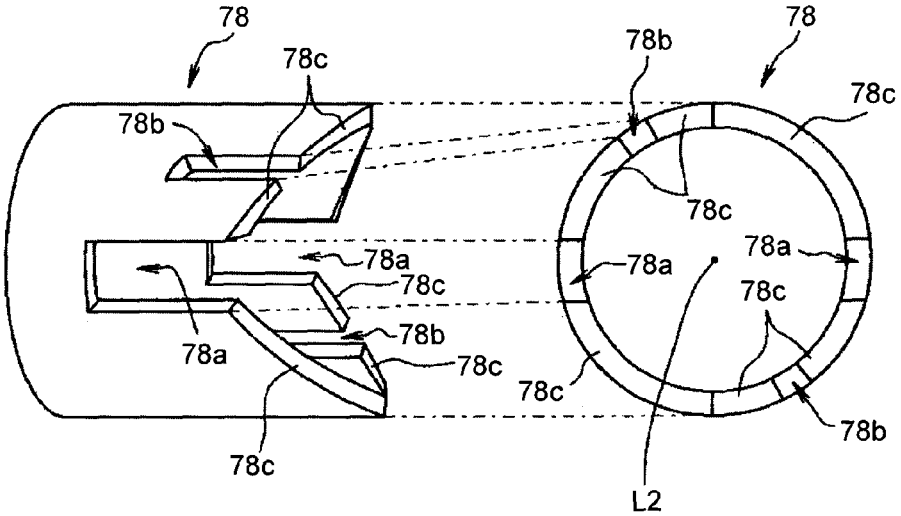
FIG. 59 is a perspective view and a front view that illustrate a container holding unit of the toner supply device according to the fifth example.

FIG. 59 is a perspective view and a front view that illustrate a container holding unit 78 of the toner supply device 70. The container holding unit 78 is rotatably supported inside the bottle drive unit 96 that is illustrated in FIG. 9, and it receives, into the inside thereof, the bottle head section 101*c* of the toner bottle 100 that is pushed toward the bottle drive unit 96 and holds the toner bottle 100. Furthermore, the four bottle holding units 78 are provided in the bottle drive unit 96 and correspond to the four colors, i.e., Y, C, M, and K, individually; however, FIG. 59 illustrates one of them. Moreover, the additional characters Y, C, M, and K that are attached to the end of the reference numerals are omitted from FIG. 59.

The container holding unit 78 includes two cutouts 78*a* that are engaged with peripheral protrusions 131 of the bottle head section 101*b* of the toner bottle that is pushed into the container holding unit 78. The cutouts 78*a* are provided at the positions that are point-symmetric with each other with respect to a rotation central axis line L2 of the container holding unit 78. Furthermore, a tapered surface 78*c* is provided on the container holding unit 78, and the tapered surface 78*c* starts from a position upstream of the cutout 78*a* in the direction in which the bottle is pushed, extends in a direction inclined with respect to the direction in which the bottle is pushed, and reaches the inlet of the cutout 78*a*.

Figure 60:
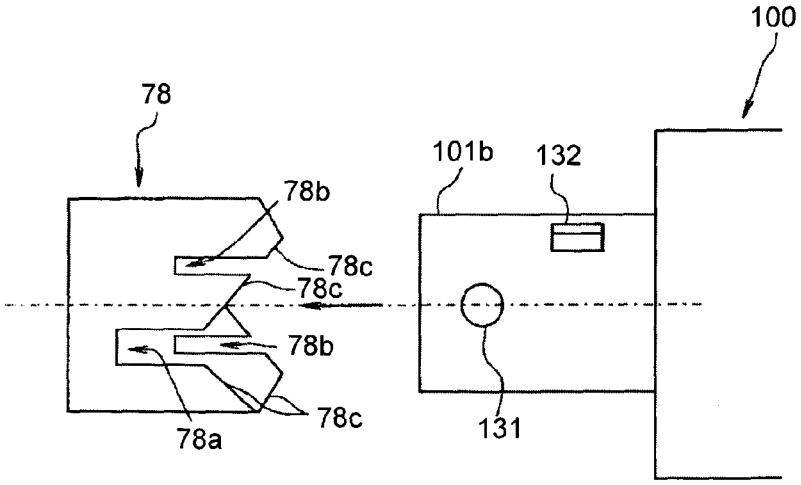
FIG. 60 is an enlarged side view that illustrates the container holding unit and the bottle head section of the toner bottle that is moved toward it.
Figure 61:
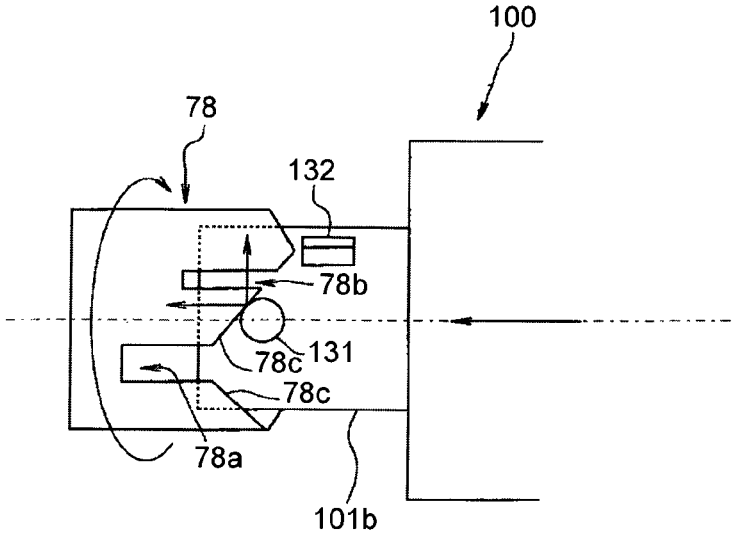
FIG. 61 is an enlarged side view that illustrates the bottle head section that is started to be pushed into the container holding unit.
Figure 62:
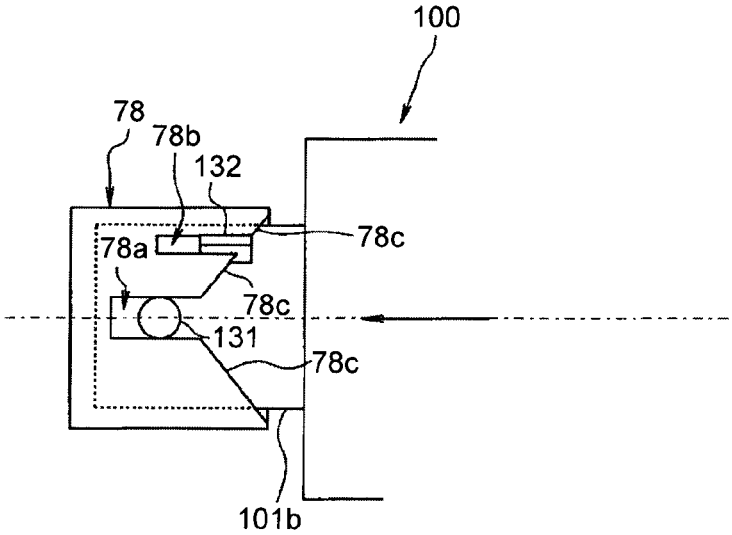
FIG. 62 is an enlarged side view that illustrates a state where the container holding unit is rotated by a peripheral protrusion on the bottle head section that is pushed into the container holding unit.
Figure 63:
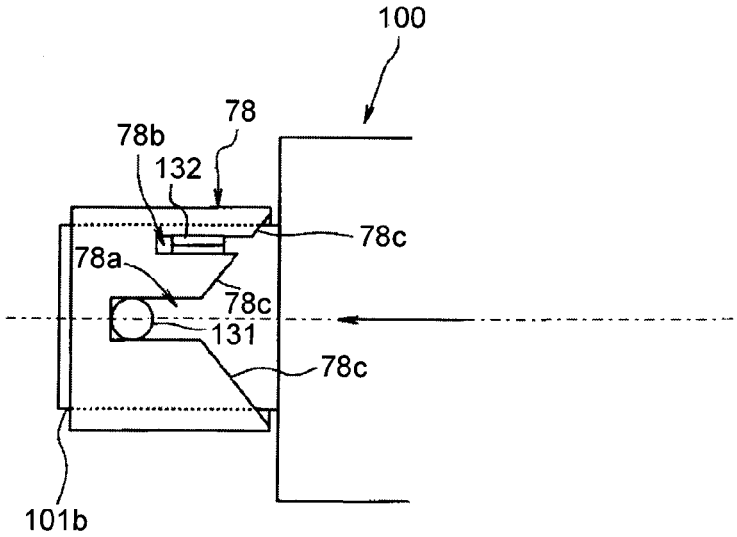
FIG. 63 is an enlarged side view that illustrates the bottle head section that is set in the container holding unit.

When an operator puts the toner bottle 100 on the bottle placement board 95 of the toner supply device 70, the rotation central axis line of the toner bottle 100 is located on an extended line of the rotation central axis line of the container holding unit 78, as illustrated in FIG. 60. In this state, the operator slides and moves the toner bottle 100 toward the container holding unit 78 of the toner supply device as indicated by the arrow in the drawing. Then, as illustrated in FIG. 61, the peripheral protrusion 131 of the toner bottle 100 is eventually brought into contact with the tapered surface 78*c* of the container holding unit 78. When the toner bottle 100 is further pushed toward the container holding unit 78 in the above state, a force to move the peripheral protrusion 131 of the toner bottle 100 in a pressure direction and a force to move it upward in a vertical direction are applied to the tapered surface 78*c*, as indicated by the arrows in the drawing. The container holding unit 78 is then rotated due to the latter force. Due to this rotation, the inlet of the cutout 78*a* provided on the container holding unit 78 is aligned to the position of the peripheral protrusion 131 in a rotation direction and, as illustrated in FIG. 62, the peripheral protrusion 131 can be received by the cutout 78*a*. Then, the toner bottle 100 is pushed to the position illustrated in FIG. 63.

As described above, in this apparatus, when the bottle head section 101*b* of the toner bottle 100 is pushed into the container holding unit 78 of the toner supply device, the container holding unit 78 is rotated so that the inlet of the cutout 78*a* of the container holding unit 78 is aligned with the peripheral protrusion 131. Thus, it is possible to easily set the toner bottle 100 in the toner supply device without adjusting the position of the toner bottle 100 in a rotation direction.

As illustrated in FIG. 58, the peripheral protrusions 131 are provided on the peripheral surface of the bottle head section 101*b* of the toner bottle 100 at the positions that are point-symmetric with respect to the cylinder central axis line L1. Furthermore, as illustrated in FIG. 59, the container holding unit 78 includes the cutout 78*a* that receives one of the peripheral protrusions 131. Furthermore, it includes the cutout 78*a* that receives the other one of the peripheral protrusions 131. The two cutouts 78*a* are provided at the positions that are point-symmetric with respect to the cylinder central axis line L2. Furthermore, the container holding unit 78 includes the tapered surface 78*c* that slides on one of the peripheral protrusions 131 and includes the tapered surface 78*c* that slides on the other one of the peripheral protrusions 131. The tapered surfaces 78*c* are provided at the positions that are point-symmetric with respect to the cylinder central axis line L2.

With this configuration, even if the toner bottle 100 is pushed toward the container holding unit 78 at any rotation angle and position, it is ensured that any one of the peripheral protrusions 131 is brought into contact with any one of the tapered surfaces 78*c*. Furthermore, it is ensured that the other one of the peripheral protrusions 131 is brought into contact with the other one of the tapered surfaces 78*c*. As a result, even if the toner bottle 100 is pushed toward the container holding unit 78 at any rotation angle and position, it is ensured that the container holding unit 78 is rotated. Then, due to this rotation, the two cutouts 78*a* can be aligned with the peripheral protrusions 131, respectively.

The two peripheral protrusions 131 of the toner bottle 100 have the same width. Furthermore, the two cutouts 78*a* of the container holding unit 78 have the same width. Therefore, it is possible that one of the peripheral protrusions 131 is received by any one of the two cutouts 78*a* and the other one of the peripheral protrusions 131 is received by any one of the two cutouts 78*a*. Thus, even if the toner bottle 100 is pushed toward the container holding unit 78 at any rotation angle and position, it is ensured that each of the two cutouts 78*a* is aligned with the peripheral protrusion 131.

As illustrated in FIG. 57, a mismounting preventing protrusion 132 is provided on the bottle head section 101*b* in addition to the peripheral protrusion 131. The mismounting preventing protrusion 132 is located at a position upstream of the peripheral protrusion 131 in a bottle pushing direction (in the direction of the arrow in the drawing). Furthermore, as illustrated in FIG. 58, the mismounting preventing protrusions 132 are provided on the peripheral surface of the bottle head section 101*b* at the positions that are point-symmetric with respect to the cylinder central axis line L1. The positions of the two mismounting preventing protrusions 132 are the same with respect to the longitudinal direction of the bottle.

Furthermore, as illustrated in FIG. 59, two mismounting preventing cutouts 78*b* are provided on the container holding unit 78 at the positions that are point-symmetric with each other with respect to the cylinder central axis line L2. The two mismounting preventing cutouts 78*b* each receive the mismounting preventing protrusion 132 of the toner bottle 100. The cutout 78*a* of the container holding unit 78 is aligned with the peripheral protrusion 131 of the toner bottle 100 in accordance with the rotation of the container holding unit 78 and, at the same time, the subsequent alignment is performed. That is, as illustrated in FIG. 62, the mismounting preventing cutout 78*b* of the container holding unit 78 is aligned with the mismounting preventing protrusion 132 of the toner bottle 100 in a rotation direction. Thus, after the alignment is performed, the mismounting preventing protrusion 132 of the toner bottle 100 is received by the mismounting preventing cutout 78*b* of the container holding unit 78.

FIG. 57 illustrates any one of the toner bottles 100 for Y, C, M, and K. The toner bottles 100 for Y, C, M, and K contain the toner of different colors, and also the installation positions of the mismounting preventing protrusions 132 of the toner bottles 100 for Y, C, M, and K are different from one another in a circumferential direction.

Furthermore, FIG. 59 illustrates any one of the container holding units 78 for Y, C, M, and K, the one corresponding to the toner bottle 100 that is illustrated in FIG. 57. The installation positions of the mismounting preventing cutouts 78*b* of the container holding units 78 for Y, C, M, and K are different from one another in a circumferential direction.

Figure 64:
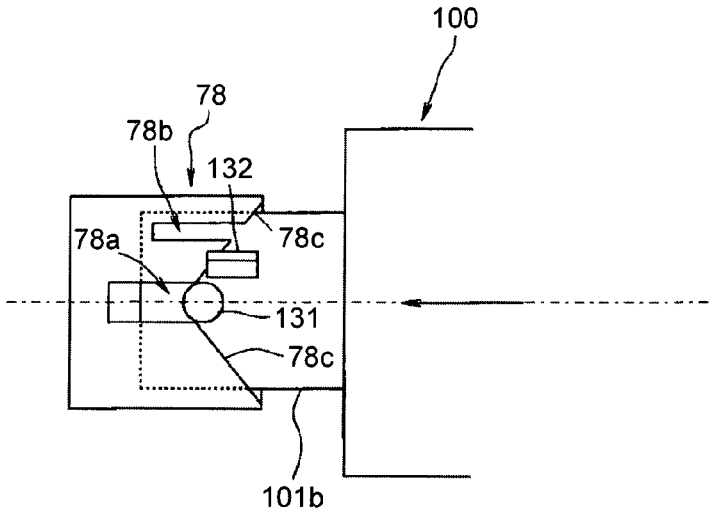
FIG. 64 is an enlarged side view that illustrates the container holding unit and the bottle head section in a state where wrong-color mismounting is prevented.

An explanation is given below of this printer on the basis of the assumption that the container holding unit 78 illustrated in FIG. 59 corresponds to Y out of Y, C, M, and K. Assume that the toner bottle 100C for C is mounted on a container holding unit 78Y. As illustrated in FIG. 64, cutout 78*a*Y of the container holding unit 78Y is aligned with the peripheral protrusion 131 of the toner bottle 100. However, in this state, the position of a mismounting preventing cutout 78*b*Y of the container holding unit 78 is misaligned with a mismounting preventing protrusion 132C of the toner bottle 100C in a circumferential direction. Therefore, the mismounting preventing protrusion 132C of the toner bottle 100C is stuck on a tapered surface 78*c*Y of the container holding unit 78Y, and the toner bottle 100C is prevented from being mounted on the container holding unit 78Y.

As described above, in this printer, if the toner bottle 100 that is to be attached to the container holding unit 78 has a different color to the corresponding color of the container holding unit 78, the mismounting preventing protrusion 132 of the toner bottle 100 is stuck on the tapered surface 78*c* of the container holding unit 78. Thus, it is possible to prevent the toner bottle 100 that has a different color from being attached to the container holding unit 78.

In FIG. 58, the two mismounting preventing protrusions 132 of the toner bottle 100 have the same width. Furthermore, in FIG. 59, the two mismounting preventing slide cutouts 78*b* of the container holding unit 78 have the same width. Moreover, this width is narrower than the width of the peripheral protrusion 131 that is illustrated in FIG. 58. Therefore, it is possible to move the peripheral protrusion 131 of the toner bottle 100 into the cutout 78*a* without mistakenly moving it into the mismounting preventing slide cutout 78*b*.

Figure 65:
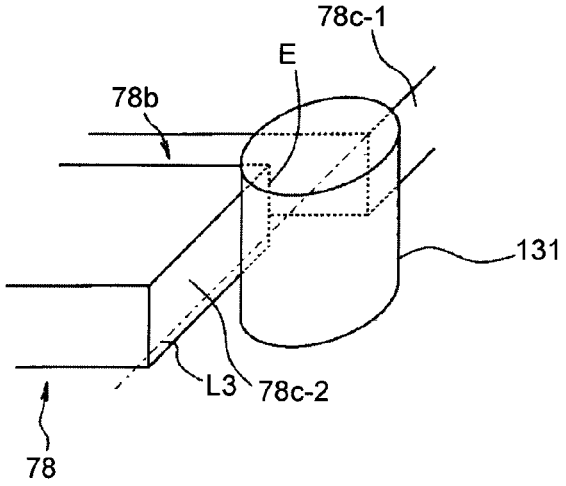
FIG. 65 is an enlarged perspective view that illustrates around a mismounting preventing cutout of the container holding unit and a mismounting preventing protrusion of the toner bottle.

FIG. 65 is an enlarged perspective view that illustrates around the mismounting preventing cutout 78*b* of the container holding unit 78 and the mismounting preventing protrusion 131 of the toner bottle. In this figure, the direction of the arrow indicates the direction in which the toner bottle is pushed. A first taper portion 78*c*-1 of the container holding unit 78 is a taper portion upstream of the mismounting preventing cutout 78*b* of the tapered surface in a pressure direction. Furthermore, a second taper portion 78*c*-2 is a taper portion downstream of the mismounting preventing cutout 78*b* of the tapered surface in a pressure direction. Moreover, a virtual extended line L3 is obtained by extending the taper of the first taper portion 78*c*-1 toward the downstream in the pressure direction. As illustrated in the drawing, in this printer, the taper of the second taper portion 78*c*-2 is located on a position downstream of the virtual extended line L3 in the pressure direction. With this configuration, it is possible to slide the mismounting preventing protrusion 131 on the tapered surface in a smooth manner without sticking an edge E of the mismounting preventing cutout 78*b* on the mismounting preventing protrusion 131 of the toner bottle 100.

Figure 66:
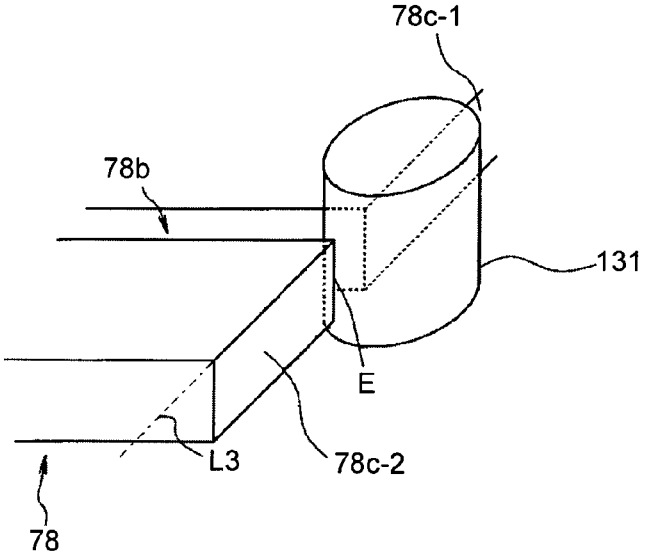
FIG. 66 is an enlarged perspective view that illustrates around a mismounting preventing cutout of a container holding unit and a mismounting preventing protrusion of a toner bottle in a comparative example.

Conversely, as illustrated in FIG. 66, assume that the taper of the second taper portion 78*c*-2 is provided at the same position as the virtual extended line L3. Then, there is a possibility that the edge E of the mismounting preventing cutout 78*b* is stuck on the mismounting preventing protrusion 131 of the toner bottle 100 as illustrated in the drawing.

Figure 71:
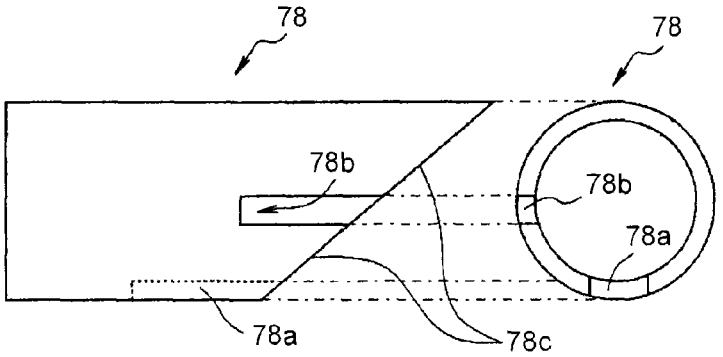
FIG. 71 is a side view and a front view that illustrate a container holding unit in a first modified example of the printer of the fifth example.

An explanation is given above of a case where the multiple cutouts 78*a* are provided on the container holding unit 78; however, with the provision of the single cutout 78*a*, it is possible to guide the cutout 78*a* toward the peripheral protrusion 131 of the bottle head section 101*b* in accordance with the rotation of the container holding unit 78. For example, the tapered surface 78*c* illustrated in FIG. 71 may be provided.

As described above, with the configuration according to the present example, an operator pushes the cylindrical toner container toward the container holding unit of the toner supply unit without adjusting the position of the toner container in a rotation direction, and the peripheral protrusion on the end section of the toner container is brought into contact with the tapered surface of the container holding unit of the toner supply unit. Then, the toner container is further pushed toward the container holding unit of the toner supply unit. Then, the peripheral protrusion of the toner container, which moves in a pressure direction, rotates the container holding unit while it slides on the tapered surface of the container holding unit. In accordance with this rotation, the inlet of the engagement section provided on the container holding unit is moved close to the peripheral protrusion of the toner container in a rotation direction and is aligned to the position of the peripheral protrusion, and the engagement section is engaged with the peripheral protrusion. Thus, according to the present invention, when the end section of the toner container is pushed into the container holding unit of the toner supply unit, the container holding unit is rotated due to the contact with the peripheral protrusion of the toner container. Therefore, it is possible to align the inlet of the engagement section of the container holding unit with the peripheral protrusion of the toner container. Thus, the operator is able to easily set the toner container in the tone supply unit without adjusting the position of the toner container in a rotation direction.

The above-described example is only an example, and the present invention produces a unique advantage with respect to each of the following aspects.

Aspect A

An image forming apparatus includes a toner-image forming unit (e.g., an image forming unit 1 and the optical writing unit 20) that forms a toner image by using toner; a toner supply unit (e.g., the toner supply device 70) that holds a toner container (e.g., a toner bottle) in a position such that a toner discharge opening (e.g., the toner discharge opening 101*c*) of the toner container faces lateral to the container, while it supplies, to the toner-image forming unit, toner that is discharged through the toner discharge opening; and a lid puling unit (e.g., the lid pulling mechanism 80) that pulls, from a container head section, a lid member (e.g., the lid member 110) that is in contact with the main body (e.g., the bottle head section 101*b*) of the toner container to close the toner discharge opening, thereby opening the toner discharge opening (e.g., the toner discharge opening 101*c*) that exists in the container head section, and it is characterized in that the lid pulling unit pulls out the lid member in a direction inclined upward with respect to a virtual line that extends in a horizontal direction.

Aspect B

An aspect B is characterized in that, according to the aspect A, the lid pulling unit pulls out the lid member in the direction inclined upward with respect to a cylinder axis line, which is the virtual line (e.g., a cylinder central axis line), of the cylindrical toner container and the toner supply unit rotates the toner container about the cylinder axis line so as to move toner in the toner container toward the main body, thereby facilitating discharge of toner through the toner discharge opening.

Aspect C

An aspect C is characterized in that, according to the aspect B, a handle section (e.g., the handle section 114) includes a rod-like section (e.g., the rod-like section 112) that protrudes from the lid member in a direction in which the lid member is pulled out and includes a large-diameter section (e.g., the large-diameter section 113) that is provided on an end section of the rod-like section and has a diameter larger than that of the rod-like section, and the lid pulling unit engages a hook member (e.g., the hook 82) thereof with the rod-like section and, while moving the hook member in the direction in which the lid member is pulled out, press it against the large-diameter section and pull the lid member.

Aspect D

An aspect D is characterized in that a toner container (e.g., the toner bottle 100) includes a toner discharge opening that is formed on the main body in one longitudinal end thereof and includes a lid member that abuts the main body so as to close the toner discharge opening, and it is attached to an image forming apparatus according to any one of the aspects A to C during use.

Aspect E

An aspect E is characterized in that, according to the aspect D, a position returning unit (e.g., the coil spring 122, the rod holding member 101*d*) is provided to return the lid member, which is pulled out of the main body and is in an inclined position with respect to the virtual line, to a position along the virtual line.

Aspect F

An aspect F is characterized in that, according to the aspect E, a cylindrical or ring-shaped plug member (e.g., the plug member 116) and a ring-shaped sealing member (e.g., the sealing member 115) are provided on the lid member, the plug member protrudes from the back surface of the lid member in a direction in which the lid member is pulled back and is inserted into the inner side of the circular toner discharge opening, and the sealing member protrudes from the back surface in the pulling-back direction so as to surround the outer side of the cylinder or ring of the plug member, is brought into contact with the main body, and is elastically deformed so as to seal the toner container.

Aspect G

An aspect G is characterized in that, according to the aspect F, a ring-shaped protrusion (e.g., the ring-shaped protrusion **101*b*-1) is provided on the main body to surround the toner discharge opening, the inner diameter of the sealing member is larger than the outer diameter of the ring-shaped protrusion, and the sealing member is brought into contact with a portion (e.g., the edge surface 101*b*-2**) of the main body that is located closer to the outer periphery of the main body compared to the ring-shaped protrusion.

Aspect H

An aspect H is characterized in that, according to the aspect G or F, a tapered surface (e.g., the tapered surface **116*a***) is provided on an outer edge section of the plug member, the tapered surface gradually decreasing the height of the plug member from the center side of the cylinder or ring toward the outer side thereof.

Aspect I

An aspect I is characterized in that, according to the aspect H, a linear step (e.g., the stepped section **116*b***) is provided at an outer edge of the tapered surface and the rising section of the plug member that rises from the back surface of the lid member.

Aspect J

An aspect J is characterized in that, according to any one of the aspects F to I, a coil spring (e.g., the coil spring 122) is provided on the position returning unit, the coil spring applies, to the lid member that abuts the main body, a force to pull it toward the main body along the virtual line and, while the lid member is pulled out of the main body and is in an inclined position with respect to the virtual line, the coil spring applies, to the lid member, a force to correct it in a position along the virtual line.

Aspect K

An aspect K is characterized in that, according to any one of the aspects F to J, an extended section (e.g., the guide rod 120) is provided on the lid member, the extended section rises from the back surface of the lid member and extends in a direction in which the lid member is pulled back, a holding member (e.g., the rod holding member **101*d***) is provided on the position returning unit, and the holding member holds the extended section in a movable manner within the container.

Aspect L

An aspect L is characterized in that, in the toner container of the aspect K, the holding member holds the extended section so as to allow it to slide along the virtual line.

Aspect M

An aspect M is characterized in that, according to the aspect L, the extended section is constituted by an elastically deformable material and, when the extended section is elastically deformed while the lid member is pulled out of the main body and is in an inclined position with respect to the virtual line, the extended section applies, to the lid member, a force to return it to a position along the virtual line, whereby the extended section serves as the position returning unit.

Aspect N

An aspect N is characterized in that, according to the aspect M, a material that produces elasticity by using a bellows-like structure or hollow structure is used as a material that constitutes the extended section and is elastically deformable.

Aspect O

An aspect O is characterized in that, according to the aspect K, the holding member holds the rod-like extended section by receiving the extended section through a holding opening (e.g., a holding hole) that is provided therein, and a coil spring is provided on the position returning unit, the coil spring applying, to the lid member pulled out of the main body, a force to pull it back to the main body.

Aspect P

An aspect P is characterized in that, according to the aspect O, tapers are provided, out of the entire area of the holding member, in an area around the holding opening on the inlet side of the holding opening and in an area around the holding opening on the outlet side thereof, the tapers being extended toward the center of the opening.

Aspect Q

An aspect Q is characterized in that, according to the aspect O or P, the configuration of the aspect H or I is used, and the difference between the inner diameter of the holding opening and the outer diameter of the extended section is equal to or less than the difference between the inner diameter of the ring-shaped tapered surface and the ring-shaped sealing member.

Aspect R

An aspect R is characterized in that, according to any one of the aspects F to Q, it is attached to an image forming apparatus of the aspect C during use, the lid member includes the handle section that includes the rod-like section and the large-diameter section, and the difference between the diameter of the toner discharge opening and the outer diameter of the plug member is less than the difference between the outer diameter of the rod-like section and the outer diameter of the large-diameter section.

Aspect S

An aspect S is characterized in that, according to O, P, or Q, a stirring blade (e.g., the stirring paddle 128) to stir the toner in the toner container is provided on an end section of the extended section in an extending direction.

Aspect T

An aspect T is characterized in that, according to the aspect O, P, Q, or R, it is attached to an image forming apparatus of the aspect C during use, the extended section has a shape of a polygonal column, the holding opening has a polygonal shape that is the same as that of the extended section in cross-section, and the holding opening applies a rotational force to the extended section that is stuck on the inner wall of the opening in accordance with the rotation thereof, thereby rotating the lid member.

Aspect U

An aspect U is characterized in that, according to the aspect T, a screw blade (e.g., the screw blade **101*j***) is provided on the holding member, the extended section, or the inner peripheral surface of the main body to convey toner inside the container toward the toner discharge opening.

Aspect a

An image forming apparatus is characterized in that it includes a toner-image forming unit (e.g., the image forming unit 1 and the optical writing unit 20) and a toner supply unit (e.g., the toner supply device 70) that rotates the cylindrical toner container (e.g., the toner bottle 100) about a cylinder central axis line while it supplies, to the toner-image forming unit, the toner discharged from the toner container, the toner supply unit drives to rotate a container holding unit (e.g., the container holding unit 78) and the toner container held by the container holding unit together, the container holding unit holds at least the end section of the toner container out of the entire area thereof in a longitudinal direction, the end section (e.g., the bottle head section) includes a peripheral protrusion (e.g., the peripheral protrusion 131) that protrudes from the outer peripheral surface in a normal direction, and the container holding unit includes an engagement section (e.g., the cutout 78*a*) that is engaged with the peripheral protrusion on the end section that is pushed into the container holding unit, wherein a tapered surface (e.g., the tapered surface 78*c*) is provided on the container holding unit, the tapered surface starts from a position upstream of the engagement section in a pressure direction in which the peripheral protrusion is pushed, extends in a direction inclined with respect to the pressure direction, and reaches an inlet of the engagement section, and when the end section is pushed into the container holding unit, the peripheral protrusion moves in the pressure direction and slides on the tapered surface to thereby applying an force to the container holding unit in a rotation direction to rotate the container holding unit, and guide the inlet of the engagement section to the peripheral protrusion in accordance with a rotation.

Aspect b

An aspect b is characterized in that, according to the aspect a, the peripheral protrusion includes peripheral protrusions that are provided on a peripheral surface of the end section at positions that are point-symmetric with respect to the cylinder central axis line, the engagement section includes an engagement section receiving one of the peripheral protrusions and an engagement section receiving the other one of the peripheral protrusions that are provided at positions that are point-symmetric with respect to the cylinder central axis line of the container holding unit, the tapered surface includes a tapered surface sliding on one of the peripheral protrusions and a tapered surface sliding on the other one of the peripheral protrusions that are provided at positions that are point-symmetric with respect to the cylinder central axis line of the container holding unit.

Aspect c

An aspect c is characterized in that, according to the aspect b, the two peripheral protrusions have the same width and the two engagement sections have the same width.

Aspect d

An aspect d is characterized in that, according to the aspect c, mismounting preventing protrusions (e.g., the mismounting preventing protrusions 132) are provided on the end section at positions that are located upstream of the peripheral protrusions in the pressure direction and that are point-symmetric with the cylinder central axis line, the mismounting preventing protrusions prevent mismounting to the container holding unit that has a specification different from a regular specification, two mismounting preventing engagement sections are provided on the container holding unit, and the mismounting preventing engagement sections are individually engaged with the respective two mismounting preventing protrusions.

Aspect e

An aspect e is characterized in that, according to the aspect d, the two mismounting preventing protrusions have the same width, the two mismounting preventing engagement sections have the same width, and the widths are narrower than the width of the peripheral protrusion.

Aspect f

An aspect f is characterized in that, according to the aspect E, with respect to the two tapered surfaces, the position of a taper portion that is located downstream of the mismounting preventing engagement section in the pressure direction is shifted downstream in the pressure direction with respect to a virtual extended line that is extended toward the mismounting preventing engagement section from a taper portion located upstream.

Aspect g

An aspect g is characterized in that, according to any of the aspects a to f, a toner discharge opening (e.g., the toner discharge opening 101*c*) and a lid member (e.g., the lid member 110) are provided on the toner container, the toner discharge opening is provided on the end section so as to discharge the toner within the end section toward the downstream of the end section in the pressure direction, the lid member abuts the end section and closes the toner discharge opening, and a lid pulling unit (e.g., the lid pulling mechanism 80) is provided to pull, from the end section, the lid member of the toner container that is attached to the toner supply unit and open the toner discharge opening.

Aspect h

An aspect h is characterized in that, according to the aspect G, a lid holding unit (e.g., the hook 82) is provided on the lid pulling unit, the lid holding unit continuously holding the lid member that is pulled out of the end section.

Aspect i

An aspect i is characterized in that, according to the aspect H, a return-force applying unit (e.g., the guide rod 120) is provided on the toner container, the return-force applying unit applying, to the lid member that is pulled out of the end section, a force in a direction to return it to the end section.

REFERENCE SIGNS LIST

1: IMAGE FORMING UNIT (PART OF TONER-IMAGE FORMING UNIT)
20: OPTICAL WRITING UNIT (PART OF TONER-IMAGE FORMING UNIT)
70: TONER SUPPLY DEVICE (TONER SUPPLY UNIT)
78: CONTAINER HOLDING UNIT
78*a*: CUTOUT (ENGAGEMENT SECTION)
78*b*: MISMOUNTING PREVENTING CUTOUT (MISMOUNTING PREVENTING ENGAGEMENT SECTION)
78*c*: TAPERED SURFACE
80: LID PULLING MECHANISM (LID PULLING UNIT)
82: HOOK (HOOK MEMBER, LID HOLDING UNIT)
100: TONER BOTTLE (TONER CONTAINER)
101*b*: BOTTLE HEAD SECTION (MAIN BODY, END SECTION)
101*b*-1: RING-SHAPED PROTRUSION
101*b*-2: EDGE SURFACE
101*c*: TONER DISCHARGE OPENING
101*d*: ROD HOLDING MEMBER 101*d* (PART OF. POSITION RETURNING UNIT)
101*j*: SCREW BLADE
110: LID MEMBER
112: ROD-LIKE SECTION
113: LARGE-DIAMETER SECTION

114: HANDLE SECTION
115: SEALING MEMBER
116: PLUG MEMBER (PLUG SECTION)
116*a*: TAPERED SURFACE
116*b*: STEPPED SECTION (STEP)
120: GUIDE ROD (ROD SECTION, RETURN-FORCE APPLYING UNIT)
120*a*: HOLLOW
112: COIL SPRING (PART OF POSITION RETURNING UNIT)
128: STIRRING PADDLE (BLADE MEMBER)
131: PERIPHERAL PROTRUSION
132: MISMOUNTING PREVENTING PROTRUSION

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

The invention claimed is:

1. A toner container that is attached to an image forming apparatus during use and that contains toner, the toner container comprising:

a toner discharge opening that is provided on a longitudinal end section of the toner container; and a lid member that closes the toner discharge opening, wherein the toner container is held by a toner supply unit of the image forming apparatus in a position such that the toner discharge opening faces in a horizontal direction, and the lid member is pulled out by a lid pulling unit of the image forming apparatus in a direction inclined upward with respect to a virtual line that extends in a horizontal direction, thereby opening the toner discharge opening.

2. The toner container according to claim 1, comprising a position returning unit that returns the lid member being pulled out of the toner container and being in an inclined position with respect to the virtual line, to a position along the virtual line.

3. The toner container according to claim 2, wherein the position returning unit includes a coil spring, and the coil spring applies, to the lid member, a force to pull the lid member in a direction to close the toner discharge opening and, when the lid member is pulled out of the toner container and is then pulled back in the direction to close the toner discharge opening again, applies a corrective force to return the lid member to a position along the virtual line.

4. The toner container according to claim 2, wherein the lid member includes a front surface and a back surface, the front surface being part of an external surface of the toner container when the lid member closes the toner discharge opening, and the back surface being opposed to the toner container, the back surface includes a cylindrical or ring-shaped plug member and a sealing member, the plug member protruding into an inside of the toner container so as to be inserted within an inner periphery of the toner discharge opening, and the sealing member protruding from the back surface so as to surround an outer periphery of the cylindrical or ring-shaped plug member, and the sealing member is brought into contact with the toner container and is elastically deformed, thereby sealing the toner discharge opening.

5. The toner container according to claim 4, wherein a ring-shaped protrusion is provided around an edge of the inner periphery of the toner discharge opening, and an inner diameter of the sealing member is set to be larger than an outer diameter of the ring-shaped protrusion, and the sealing member comes into contact with a portion of the toner container that is located outside the ring-shaped protrusion in a radial direction.

6. The toner container according to claim 4, wherein a tapered surface is provided on an outer edge portion of the plug member, the tapered surface gradually decreasing a height of the plug member from a center side thereof toward an outer side.

7. The toner container according to claim 6, wherein a step is provided on the plug member at an outer edge of the tapered surface, the step rising from the back surface of the lid member toward an inside of the toner container.

8. The toner container according to claim 4, wherein the position returning unit includes a rod section that rises and extends from the back surface of the lid member, and when the lid member is moved in a direction in which the lid member is pulled out of the toner container or in a direction to close the toner discharge opening, the rod section is held by a holding member, the holding member being provided within the toner container so as to guide a movement of the lid member.

9. The toner container according to claim 8, wherein the holding member holds the rod section such that the rod section slides when moving along the virtual line.

10. The toner container according to claim 9, wherein the rod section is elastically deformable, and when the lid member is pulled out of the toner container and is then moved in the direction to close the toner discharge opening again, the rod section applies a corrective force to return the lid member to a position along the virtual line.

11. The toner container according to claim 10, wherein the rod section includes a bellows-like structure or hollow structure.

12. The toner container according to claim 8, wherein the holding member includes a holding opening that holds the rod section, the position returning unit includes a coil spring, and the coil spring applies, to the lid member, a force to pull the lid member in the direction to close the toner discharge opening and, when the lid member is pulled out of the toner container and is then pulled in the direction to close the toner discharge opening again, applies a corrective force to return the lid member to a position along the virtual line together with the rod section.

13. The toner container according to claim 12, wherein tapers are provided on the holding member in a portion around the holding opening on one end side of the holding opening and in a portion around the holding opening on other end side thereof, and the tapers are extended toward a center of the holding opening.

14. The toner container according to claim 12, wherein a tapered surface is provided on an outer edge portion of the plug member, the tapered surface gradually decreasing a height of the plug member from a center side thereof toward an outer side thereof, and a difference between an inner diameter of the holding opening and an outer diameter of the rod section is equal to or less than a difference between an inner diameter of the ring-shaped tapered surface and the ring-shaped sealing member.

15. The toner container according to claim 14, wherein a step is provided on the plug member at an outer edge of the tapered surface, the step rising from the back surface of the lid member toward an inside of the toner container.

16. The toner container according to claim 12, wherein the rod section has a polygonal shape in cross-section in a direction perpendicular to a direction in which the rod section extends, and the holding opening has an inner wall surface that transmits a rotative force to an outer surface of the rod section when the holding opening is rotated together with the toner container.

17. The toner container according to claim 16, wherein the holding opening has a same shape as the cross-sectional shape of the rod section.

18. The toner container according to claim 8, wherein a stirring blade to stir toner is provided on the rod section at an end that extends toward an inside of the toner container.

19. The toner container according to claim 8, wherein a screw blade to convey toner inside the toner container toward the toner discharge opening is provided on at least one of the holding member, the rod section, and an inner wall surface of the toner container.

20. The toner container according to claim 4, wherein the lid member includes a handle section, the handle section including:

a rod-like section that outwardly protrudes from the front surface; and a large-diameter section that is provided on the rod-like section at an end located away from the front surface, the large-diameter section having a diameter larger than a diameter of the rod-like section.

21. The toner container according to claim 20, wherein a difference between a diameter of the toner discharge opening and an outer diameter of the plug member is less than a difference between an outer diameter of the rod-like section and an outer diameter of the large-diameter section.

22. The image forming apparatus comprising:

the toner container according to claim 20;

a toner-image forming unit that forms a toner image by using toner;

the toner supply unit that holds a toner container with the toner discharge opening of the toner container facing in a horizontal direction, and that supplies, to the toner-image forming unit, toner that is discharged through the toner discharge opening; and a lid pulling unit that pulls out, from the toner container, the lid member by using a hook member that is engaged with a handle section that is provided on a lid member, thereby opening the toner discharge opening, wherein the lid pulling unit engages the hook member with the rod-like section of the handle section and, while moving the hook member in a direction in which the lid member is pulled out, press the hook member against the large-diameter section of the handle section and pull out the lid member in the direction inclined upward with respect to the virtual line that extends in the horizontal direction.

23. The image forming apparatus according to claim 22, wherein the toner container has a cylindrical shape, the lid pulling unit pulls out the lid member in the direction inclined upward with respect to a cylinder axis line of the cylindrical toner container as the virtual line, and the toner supply unit rotates the toner container about the cylinder axis line so as to move toner in the toner container toward the toner discharge opening, thereby facilitating discharge of toner through the toner discharge opening.

24. An image forming apparatus comprising:

the toner container according to claim 1;

a toner-image forming unit that forms a toner image by using toner;

the toner supply unit that holds the toner container with the toner discharge opening of the toner container facing in the horizontal direction, and that supplies, to the toner-image forming unit, toner that is discharged through the toner discharge opening; and a lid pulling unit that pulls out, from the toner container, the lid member that closes the toner discharge opening, thereby opening the toner discharge opening, wherein the lid pulling unit pulls out the lid member in the direction inclined upward with respect to the virtual line that extends in the horizontal direction.

25. The image forming apparatus according to claim 24, wherein the toner container has a cylindrical shape, the lid pulling unit pulls out the lid member in the direction inclined upward with respect to a cylinder axis line of the cylindrical toner container as the virtual line, and the toner supply unit rotates the toner container about the cylinder axis line so as to move toner in the toner container toward the toner discharge opening, thereby facilitating discharge of toner through the toner discharge opening.

26. The image forming apparatus according to claim 24, wherein the toner container includes a peripheral protrusion that protrudes from an outer peripheral surface of a cylindrical end section thereof in a normal direction, the toner supply unit drives and rotates a container holding unit and the toner container held by the container holding unit together, the container holding unit holding at least the end section out of an entire area of the toner container in a longitudinal direction, the container holding unit includes an engagement section that is engaged with the peripheral protrusion of the end section that is pushed into the container holding unit, a tapered surface is provided on the container holding unit, the tapered surface starting from a position upstream of the engagement section in a pressure direction in which the peripheral protrusion is pushed, extending in a direction inclined with respect to the pressure direction, and reaching an inlet of the engagement section, and when the end section is pushed into the container holding unit, the peripheral protrusion moves in the pressure direction and slides on the tapered surface to thereby apply an force to the container holding unit in a rotation direction to rotate the container holding unit, and guide the inlet of the engagement section to the peripheral protrusion in accordance with a rotation.

27. The image forming apparatus according to claim 26, wherein the peripheral protrusion includes peripheral protrusions that are provided on the peripheral surface of the end section at positions that are point-symmetric with respect to the cylinder central axis line, and the engagement section includes an engagement section receiving one of the peripheral protrusions and an engagement section receiving other one of the peripheral protrusions that are provided on the container holding unit at positions that are point-symmetric with respect to the cylinder central axis line, and the tapered surface includes a tapered surface sliding on one of the peripheral protrusions and a tapered surface sliding on other one of the peripheral protrusions that are provided on the container holding unit at positions that are point-symmetric with respect to the cylinder central axis line.

28. The image forming apparatus according to claim 27, wherein the two peripheral protrusions have a same width and the two engagement sections have a same width.

29. The image forming apparatus according to claim 28, wherein mismounting preventing protrusions are provided on the end section at positions that are located upstream of the peripheral protrusions in the pressure direction and that are point-symmetric with respect to the cylinder central axis line, the mismounting preventing protrusions preventing mismounting to the container holding unit that has a specification different from a regular specification, and, two mismounting preventing engagement sections are provided on the container holding unit, the mismounting preventing engagement sections being individually engaged with the respective two mismounting preventing protrusions.

30. The image forming apparatus according to claim 29, wherein the two mismounting preventing protrusions have a same width, the two mismounting preventing engagement sections have a same width, and the widths are narrower than the width of the peripheral protrusion.

31. The image forming apparatus according to claim 30, wherein, with respect to each of the two tapered surfaces, a position of a taper portion that is located downstream of the mismounting preventing engagement section in the pressure direction is shifted downstream in the pressure direction with respect to a virtual extended line that is extended toward the mismounting preventing engagement section from a taper portion located upstream.

32. A toner container, comprising:

a toner discharge opening on a longitudinal end section of the toner container, the toner discharge opening facing in a horizontal direction when the toner container is attached to an image forming apparatus; and a lid that closes the toner discharge opening, and is pulled out by a lid pulling unit of the image forming apparatus in a direction inclined upward to open the toner discharge opening.

33. The toner container of claim 32, wherein the toner container stores toner.

34. A toner container, comprising:

a toner discharge opening on a longitudinal end section of the toner container, the toner discharge opening facing in a horizontal direction when the toner container is attached to an image forming apparatus; and a lid that closes the toner discharge opening, and is pulled out by a lid pulling unit of the image forming apparatus to open the toner discharge opening, wherein a lower clearance area between the toner discharge opening and the lid, generated when the lid is pulled out, is larger in a vertical direction than an upper clearance area between the toner discharge opening and the lid.

35. The toner container according to claim 34, wherein a first distance between a lower end of the lid and a lower end of the discharge opening is larger than a second distance between an upper end of the lid and an upper end of the discharge opening.

36. The toner container of claim 34, wherein the toner container stores toner.

* * * * *